US012790082B1

(12) United States Patent
Vovan

(10) Patent No.: US 12,790,082 B1
(45) Date of Patent: Nov. 10, 2026

(54) PULL-TAB TAMPER-EVIDENT CONTAINER

(71) Applicant: Terry Vovan, Anaheim, CA (US)

(72) Inventor: Terry Vovan, Anaheim, CA (US)

( * ) Notice: Subject to any disclaimer, the term of this patent is extended or adjusted under 35 U.S.C. 154(b) by 25 days.

(21) Appl. No.: 19/253,894

(22) Filed: Jun. 29, 2025

(51) Int. Cl.
*B65D 43/02* (2006.01)

(52) U.S. Cl.
CPC ..... *B65D 43/0237* (2013.01); *B65D 2401/15* (2020.05); *B65D 2543/00296* (2013.01); *B65D 2543/00694* (2013.01)

(58) Field of Classification Search
CPC ..... B65D 43/0237; B65D 2401/15; B65D 2543/00296; B65D 2543/00694; B65D 2401/10; B65D 2543/00101; B65D 2543/00194
See application file for complete search history.

(56) References Cited

U.S. PATENT DOCUMENTS 8,640,914 B2 * 2/2014 Meyer ..... B65D 43/0258 206/508
9,278,786 B2 * 3/2016 Vovan ..... B65D 43/0254
11,091,300 B2 * 8/2021 Yu ..... B65D 43/0212
11,664,248 B2 * 5/2023 Saito ..... H01L 21/67109 156/367
11,702,254 B2 * 7/2023 Lee ..... B65D 45/20 220/268
12,202,642 B2 * 1/2025 Wang ..... B65D 11/188
2021/0237946 A1 * 8/2021 Jackson ..... B65D 43/164
2024/0239552 A1 * 7/2024 Wang ..... B65D 11/188

* cited by examiner

*Primary Examiner* — Shawn M Braden
(74) *Attorney, Agent, or Firm* — Law Office of Lewis Brande; Lewis M Brande

(57) ABSTRACT

This unique invention generally relates to a tamper-evident plastic packaging device, method of use, and the production of containers. Particularly, the plastic food packaging container consists of two to three components a cover, base that holds the goods, where the pull-tab assembly extends from the lid/cover and attaches to the base, and has a through precut channel between the pull-tab and the hold-down, which are connected by frangible joints. When opening the tamper-evident package by pulling the pull-tab out and downward, that breaks the frangible joints along the precut channel, which separates the inner section hold-down away from the pull-tab. The pull-tab and hold-down assemblies are now broken and separated, whereas the hold-down is attached to the vertical retaining wall of the hold-down receptacle by the male-female lock, while the pull-tab indicates missing a center component of the hold-down. Thereby provides visual evidence that tampering has occurred.

23 Claims, 15 Drawing Sheets

PULL-TAB TAMPER-EVIDENT CONTAINER

FIELD OF THE INVENTION

This unique invention generally relates to a tamper-evident plastic packaging device, method of use, method of manufacturing, and the production of containers from various polypapers, polymers, or copolymers, or from recyclable plastics to compostable or biodegradable materials. Particularly, the plastic food packaging containers consist of two to three components of the lid or cover, and the base or container which generally holds the goods, where the pull-tab assembly has a frangible break line where the act of pulling the pull-tab breaks an outer section away from an inner hold-down, and once the frangible section is broken, provides evidence that the container was opened, since both parts of the pull-tab assembly are now separated and the outer pull-tab bent outwards at an angle.

23 Claims, 15 Drawing Sheets

BACKGROUND OF THE INVENTION

Numerous food packaging containers are being sold and used at many locations such as grocery stores, bakeries, restaurants, convenience stores, and airports. The cakes, pies, pastries, and other delights are typically packaged in transparent plastic containers or paperboard with plastic components. In addition, these containers are generally made in the shape of polygons, a square or rectangular shape known as the term "sheet cakes"; other round shapes as "round cakes" and "pie cakes". The package components consist of a base with a large surface containing foods or bakery products, either with or without a cake board, and a translucent cover enclosing the base. Generally, buyers assume that the food inside the plastic container has not been opened after the store clerk closed it. However, it is possible that another shopper has surreptitiously opened the container to sample the frosting, consumed a small part of the food, added a foreign substance before closing it, or potentially transmitted germs from their finger to the food. Potential buyers, therefore, seek assurance that the contents have not been tampered with. This plastic food package design, has a unique tamper-evident pull-tab function, would give the purchaser of the product and the business a sense of security by ensuring that their fresh baked products are not tampered with at the point of sale.

As such, there exists a need in the art for a unique tamper-evident plastic packaging device or container, a method of use, and the production of container materials from various polypapers, polymers from recyclable plastics, compostable, biodegradable, to oven-able polymers, and composites.

There also exists a particular need in the plastic food packaging container industry for a new device that consists of two to three components of the lid or cover, and the base that holds the goods, where the pull-tab assembly extends from the top lid/cover and attaches to the base, and has a through precut channel between the pull-tab and the hold-down, which are connected by frangible joints that makes it obvious to a purchaser or the business that the container has not been tampered with.

Lastly, there exists a need in the art for a new tamper-evident packaging device, when opening the tamper-evident package by pulling the pull-tab out and downward, that breaks the frangible joints along the precut channel, which separates the inner section hold-down away from the pull-tab. The pull-tab and hold-down assemblies are now broken and separated, whereas the hold-down is attached to the vertical retaining wall of the hold-down receptacle by the male-female lock with a taper V shape, while the pull-tab indicates missing a center component of the hold-down, and pivots outward several degrees by a resilient hinge. Wherein, this provides visual evidence that tampering has occurred because the hold-down and pull-tab cannot be re-attached.

BRIEF SUMMARY OF THE INVENTION

The object of this invention is to provide a unique tamper-evident plastic packaging device, a method of use, and the production of containers from various polypapers, polymers from recyclable plastics, and compostable or biodegradable materials.

Another object of this invention is to provide a plastic food packaging container, which has a tamper-evident feature wherein the cover has a peripheral rim disposed on the base. The base has a protruded upward flange adjacent to the undercut to conceal the peripheral rim to avoid the passage of air and moisture to reduce the food shelf life.

Another object also presents in this invention to provide a pull-tab assembly that protrudes from the lid/cover rim and extends beyond the base's periphery edge with a pivoting hinge or folded line. This pull-tab assembly comprises two components, a pull-tab and a center hold-down, which are separated by a through precut channel and only connected by the frangible joints. In addition, a protruding rib can be formed adjacent to each side of the hold-down to increase the stiffness and reinforce the pull-tab strength for multiple uses. Conversely, it can also display the bending/folding line of the pull-tab when it opens multiple times due to stretching of the thin section of plastic, which also enhances the visual display of tampering.

A further object of the present invention is to provide a new method of closing the plastic package altogether. In effect, the store clerk quickly aligns the cover to the base. He/she can pivot the pull-tab assembly downward and the hold-down aligned to the male or female snap-lock feature on the positional aligner of the cover. Particularly in the rectangular and square tamper-evident plastic containers, the pull-tab assembly generally positions at the corner for self-alignment, while the round or oval package requires an alignment feature to facilitate a proper alignment between the pull-tab assembly and the hold-tab receptacle.

It is also another object of the present invention to provide a new method providing a positional aligner that includes a pivotal hinge that connects and aligns both center lines of the male and female snap-locks and symmetrical trapezoid ramps that have the same raised taper and recess between the cover skirt and the base, thus enabling positive alignment when the cover and base are engaged. This is most prevalent on the round package containers that have a tendency to rotate about the central Z axis without a positional alignment feature.

The trapping portion is disposed below the perimeter flange of the base, which has an undercut that conceals the peripheral edge of the cover when it is fully closed, thereby preventing finger prying. Other attempts at prying may cause the food products inside the transparent container to be damaged or tilted, or the cake frosting may be smeared in the store, which becomes undesirable for the consumer to purchase.

Furthermore, the pull-tab assembly is preferably situated in a corner of the square, rectangular, or polygonal shape of the container, providing the initial leverage required to open the package without damaging the cake products or goods. After closing, the store clerk has secured the container with the food inside; The consumer must pull the pull-tab outward and upward to open the tamper-evident container. by pulling the pull-tab outward, the consumer breaks the frangible joints along the precut channel and separates the center hold-down from the pull-tab.

When the consumer grasps and pulls the top of the pull-tab assembly, it separates from the upper first attached point to the last attached point, allowing the container to be opened. This action tears/breaks the frangible joints along the precut channel of the pull-tab assembly, while the hold-down is attached to the trapping slot or the male/female snap-lock configuration once engaged. The separation of the hold-tab from the pull-tab assembly visually indicates unauthorized tampering as these components cannot be reattached or secured.

It is still yet another object of the present invention is to provide a new method for providing visual evidence that tampering has occurred because the hold-down and pull-tab cannot be re-attached or resecured.

It is a further object of this invention to create a new tamper-evident plastic container that is easy to manufacture, reliable in operation, and relatively inexpensive to produce. The common selected plastic materials selected because they are easy to fabricated using processes consisting of thermoforming, injection molding, casting, stamping, CNC machining, laser, water jet cutting, 3D printing and any combination thereof.

TERMINOLOGY DEFINITION

Figure 1:
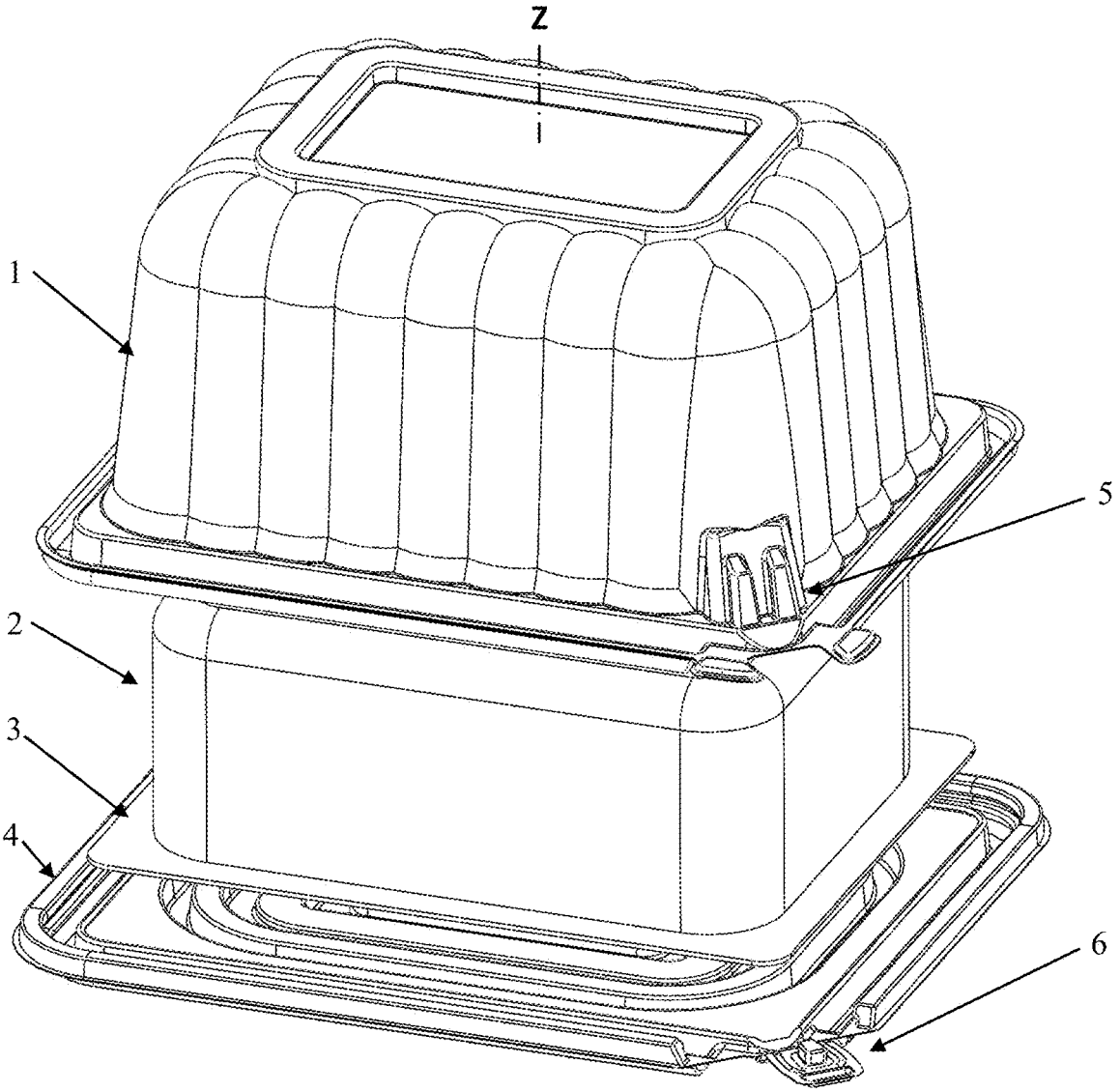
FIG. 1 exhibits an isometric exploded view of a tamper-evident square/rectangular sheet cake package with all standard components are disposed about the central Z axis. The pull-tab assembly and the hold-down receptor are located at the bottom corner of the tamper-evident package.
Figure 10:
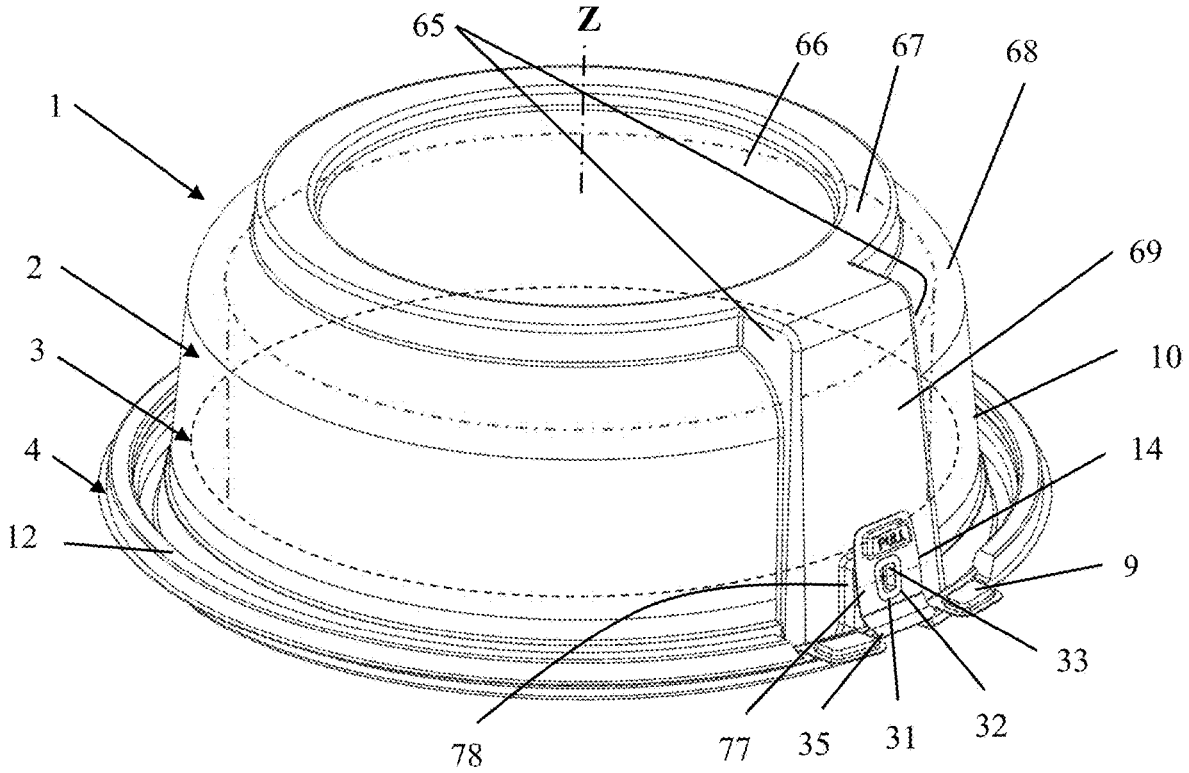
FIG. 10 exhibits a round or oval tamper-evident cake container with the pull-tab assembly disposed below the label panel. The pull-tab assembly attached vertically to the hold-down receptacle without stiffener ribs.

Terms such as "dome," "lid," and "cover" are references to the top component that is being used in the food packaging field, which describes an element to be used covering the food products. Conversely, the terms "container," "base," and "tray" are being used to support or contain the food or cake products. i.e., a cake package container is shown in FIG. 1 or FIG. 10, wherein the description of item number 4 refers to the "base" and item number 1 as the "cover" or the "dome" for using the large cake items. However, for the smaller items such as brownies, cupcakes, cookies, etc., the package container would be used and inverted upside down so the terminology of a "dome" or "cover" can be used as a "container" for the smaller food items.

The term "an alignment feature" is not only being used to prevent rotational misalignment between the round "cover" and the round "base", and ensure proper alignment of a pull-tab assembly to a pull-tab receptacle but also being used for the square, rectangular, or polygonal container applications. Furthermore, this also provides a visual guide for the store clerks or consumers to understand by having one direction of closing the container so the alignment of the pull-tab technology can be intuitively applied.

The present disclosure should not be limited to the illustrated orientation, but other applications or orientations are possible.

Most of the embodiments and definitions that have been described herein are in connection with the accompanying drawings and the figures, descriptions and claims are within the scope of the disclosed invention.

SUMMARY OF THE DESCRIPTION

A food container 147 and a lid 148 are oriented around the central Z axis to engage and close together. The taper alignment feature 151 between the container's female taper wall 108 and the lid's male taper 110 provides self-alignment, prevents rotational misalignment, and further ensures that the pull-tab assembly 153 is properly aligned with the pull-tab receptacle 161 when they are engaged. Particularly, the round lid 148 and round container 147 are essentially required.

Figure 24:
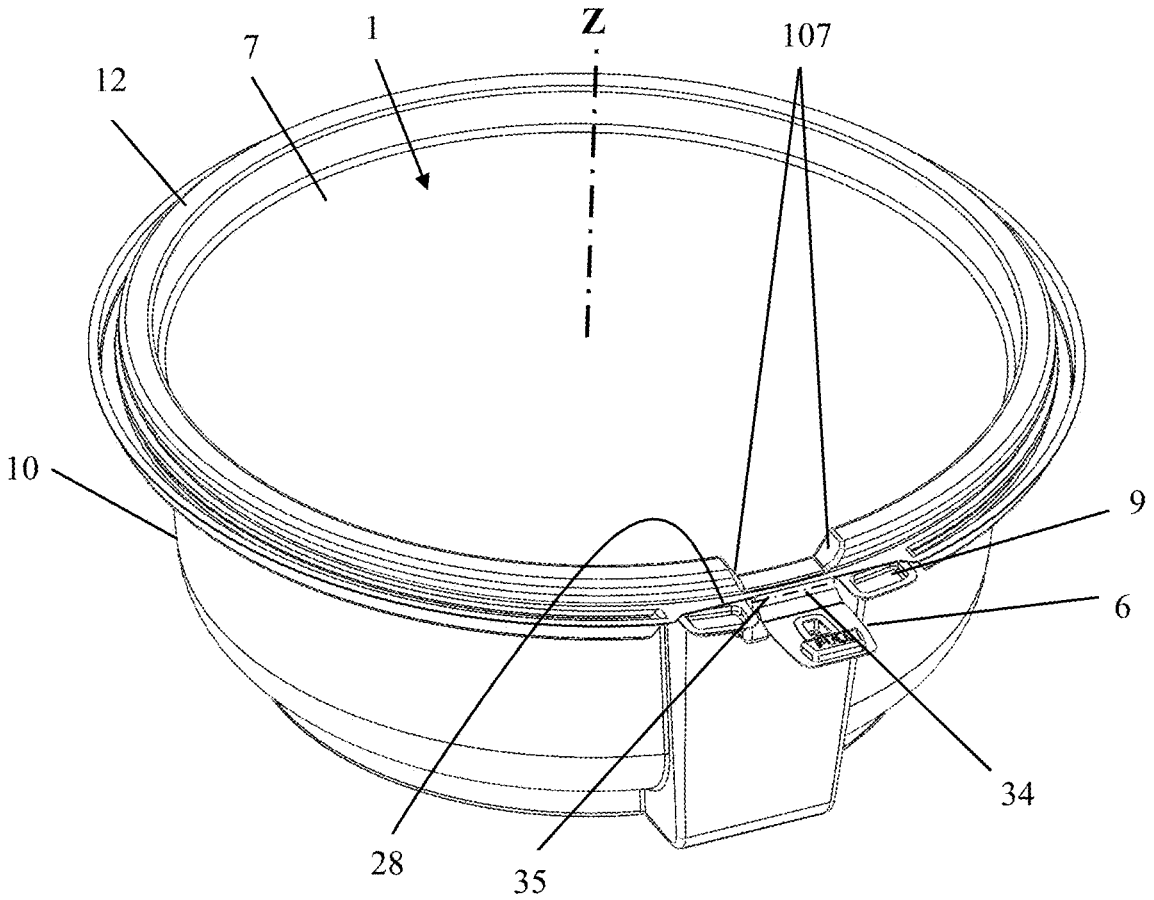
FIG. 24 exhibits an isometric view of the tamper-evident container, which is inverted from the previous package, wherein the food products are placed inside of the container (base), and the cover (lid) is disposed on the top of the package.

The pull-tab assembly 153 is formed and connected to the lid's peripheral edge 168 by a resilient hinge 154 extended outward from the central Z axis while the container's perimeter edge 155 is being disposed in the channel 95 or the cover raised rib 149 of the lid 148 (FIG. 24). Furthermore, the container perimeter edge 155 is also recessed below the resilient hinge 154 of the lid, which may extend outward up to the center line of the resilient hinge. Thereby, the pull-tab assembly can align and pivot downward about the center datum axis without restriction or obstruction.

Figure 25:
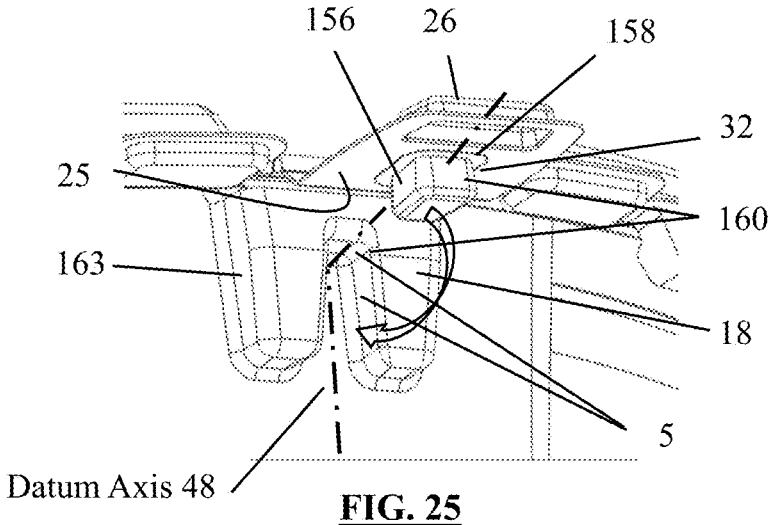
FIGS. 25 & 25*a* exhibit an enlargement of the pull-tab assembly, before and after the pull-tab is assembled and aligned and through the center datum Axis as an undeployed condition.

When the pull-tab assembly 153 is pivoted downwardly, the hold-down 160 has a male/female snaplock 156 that is aligned and engaged to the male/female snaplock 162 of the receptacle 5, 89, 105, while the pull-tab facet 164 is resting against the receptacle facet 161 (FIG. 25). The pull-tab assembly before it engages with the hold-down 160 is separated from the pull-tab by a precut channel 158 and connected by frangible joints 159. The male/female snaplock 156 of the hold-down 153 and the male/female snaplock 162 of the receptacle 168 are matched and conformed with a slight taper of a "V"-shaped structure with undercuts to increase retention when the lid 148 and container 147 are forced apart without the deployment of the pull-tab. Furthermore, the hold-down 160 of the pull-tab assembly continues to increase retention by wedging with the receptacle based on the weight of the product inside the package. To open the container, the consumer grasps the finger grip 157 of the pull-tab 153 and pulls the top of the pull-tab assembly 109, causing it separates from the upper first attached point 42 to the last attached point 46, allowing the product to be opened. This action tears/breaks frangible joints 159 along the precut channel 158 of the pull-tab assembly, while the hold-down 168 is attached to the trapping "V" slot or the male/female snap-lock configurations 156, 162 once they are engaged. The separation of the hold-down 153 from the pull-tab assembly 109, which exhibits a void 169 on the pull-tab, indicates tampering because these components cannot be reattached.

Furthermore, another visual indication of tampering is when the pull-tab 153 doesn't have the raised ribs 30, which provide a high degree of deformation when it is being pulled outward due to a thin section of the material.

DETAILED DESCRIPTION OF THE INVENTION

The novel invention and unique features are presented with a detailed description and accompanying drawings are provided to illustrate and describe the preferred embodiments of the unique invention. They are not intended to limit the scope of the invention in any way. The invention will be best understood from the following description when read in conjunction with the accompanying drawings.

It is also recognized that any modifications or deviations of this application's features, material arrangements of parts, or operational conditions described, and illustrated herein, by variations may occur to those skilled in the art, and hence it is intended and suggested that the claims shall be considered to include such modifications and equivalents.

FIG. 1 exhibits an exploded isometric view of a tamper-evident (TE) square or rectangular single-hinged package or a two-piece polymer package with a cover 1. Foods or baked goods 2 are disposed on the paperboard 3, which is placed on the base 4. These components are respectively arranged about the central Z axis, with the pull-tab receptacle 5 preferably located at the bottom corner of the "cover". According to the height of the package's tall is as a "dome" or short and flat is as a "cover," the applicant consistently prefers using this nomenclature as a "cover" in the description and claims although others may call it as different names; however, it is mainly described as a component that covers or protects the foods inside of the package. In addition, the TE pull-tab assembly 6 is also located at the corner and vertically aligned with the receptacle unit.

Figure 2:
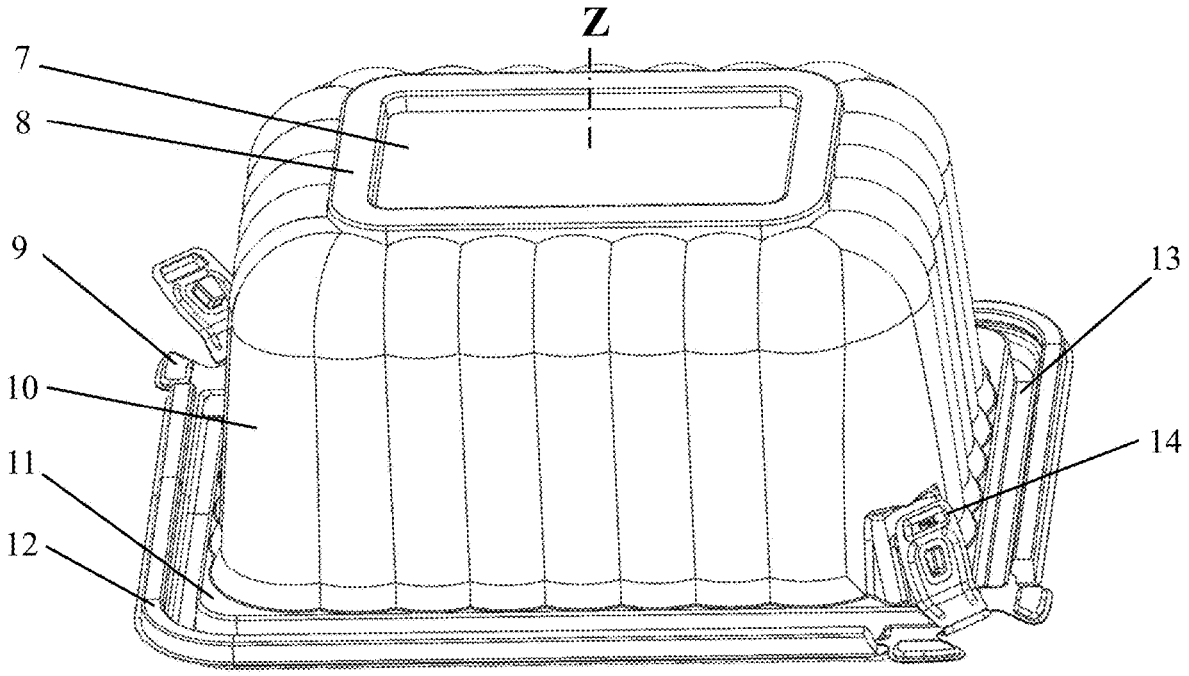
FIG. 2 exhibits an isometric view of a tamper-evident square/rectangular sheet cake package, and the components of the cake package are fully aligned and closed. The pull-tab assembly is also engaged with the hold-down receptacle.

FIG. 2 exhibits an isometric assembly view of a tamper-evident (TE) square or rectangular package, which is commonly preferred as "Sheet Cake." The cover upper wall 7 is generally flat and made of translucent plastics, which enable product viewing, labeling, and multiple stacking. A peripheral raised rib 8 is adjacent to the upper wall and conforms to the cover shape, providing stacking and alignment with the bottom of another base 4 about the central Z axis. The lift-tab(s) 9 is extended outwardly beyond the peripheral edge 20 base perimeter flange 12, while the cover bottom wall 13 is disposed in parallel with the perimeter flange and adjacent to the cover sealing wall 52 (FIG. 8) and peripheral edge 20. The resilient hinge of the undeployed pull-tab assembly 14, which provides a unique TE feature to facilitate the opening of the package. The peripheral sidewall 10 of the cake cover can be formed into various shapes and sizes, which is located adjacent to the horizontal holding wall 11 for the cake board. A base perimeter flange 12 has the same horizontal plan as the holding wall, with a base recess groove 45 (FIG. 8), which conceals and protects the peripheral edge 20 (FIG. 3) from prying.

Figure 3:
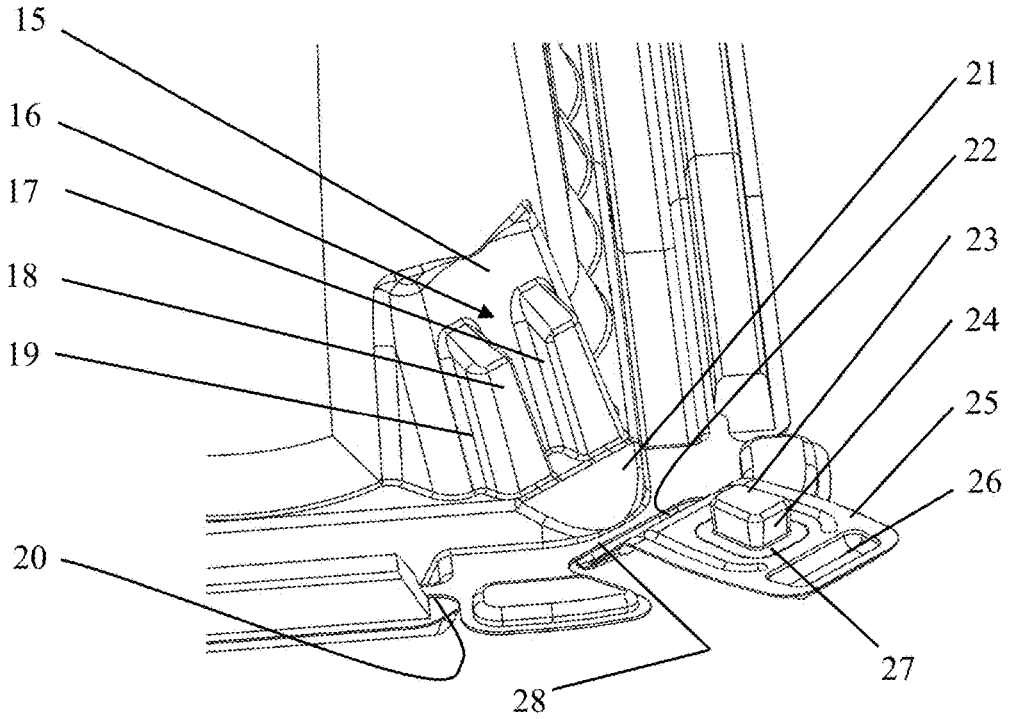
FIG. 3 exhibits an isometric large view of the opened tamper-evident pull-tab assembly before the hold-down engages with the male/female internal retainer wall.

FIG. 3 exhibits an isometric assembly view of a tamper-evident (TE) feature of the pull-tab assembly before engaging. The receptacle snap-lock 5 is aligned to the pull-tab assembly 6, which is located in the bottom corner of the package. A flat protruded wall 15 raised from the peripheral sidewall 10 and the retainer sidewalls 19 are the foundation of the receptacle snap lock 5 configuration (FIGS. 3 & 4*a*); however, the locking feature can also be formed directly from the peripheral sidewall 10 of the cover that provides a higher retention force than the shearing or breaking force of the frangible joint 32. An open slot 16 located above and between the receptacle snap-locks of the internal retaining walls 17 is spaced to provide a gap for finger access, and the receptacle front facet 18 is adjacent to the internal retainer wall and the retainer wall. In addition to the interface between the pull-tab facet 25 and the receptacle front facet 18, the receptacle ramp 21 and the pull-tab ramp 22 are simultaneously interfaced when the pull-tab assembly is fully engaged. The peripheral edge 20 is flat and prefers sharing the same level as the hinged recess edge 28, which is extending beyond the hinged center axis 34 (FIG. 4) of the resilient hinge 35. In addition, the peripheral edge 20 of the cover and the lift-tab edge 9 have the same planetary. The hold-down 27 includes a male lock facet 23 and the undercut sidewall 24, wherein the male lock facet 23 is spaced from the protruded wall 15, or the peripheral sidewall 10 of the cover when the pull-tab assembly 6 is engaged with the pull-tab receptacle 78. Furthermore, to prevent the slipping of the finger when grasping the pull-tab from an undeployed condition, a finger grip 26 is formed with various shapes and sizes and disposed at the top of the pull-tab 29.

Figure 4:
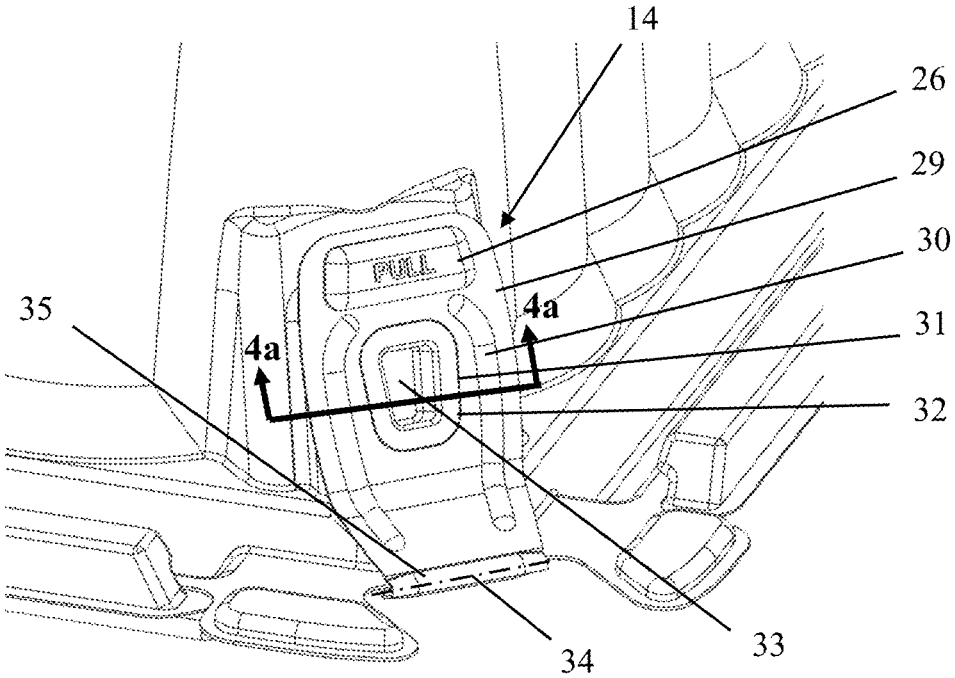
FIG. 4 exhibits the tamper-evident pull-tab assembly is fully engaged with the hold-down receptacle as typically displayed the tamper-evident package on the store shelves.

FIG. 4 exhibits an isometric view of the undeployed pull-tab assembly 14, wherein the finger grip 26 is formed and disposed at the upper side of the pull-tab to facilitate opening the tamper-evident container. To strengthen the stiffness of the pull-tab, the raised rib 30 is preferably added to both sides of the hold-down 27. These raised/recessed ribs are adjacent to a through precut channel 31, which separated the hold-down 27 and the pull-tab 29, wherein the frangible joints 32 connect these components together as a pull-tab assembly. The pull-tab 29 can be formed with various shapes and sizes to suit its application. A resilient hinge 35 is located at the end of the pull-tab assembly and connected to a corner of the base wherein the recess edge 28 (FIG. 3) of the cover cannot extend beyond the center line axis 34 of the resilient hinge that may hinder the closing of the TE pull-tab assembly. A hold-down snap-lock 33 configuration can be designed with various shapes and sizes and located about the center of the hold-down.

Figure 4A:
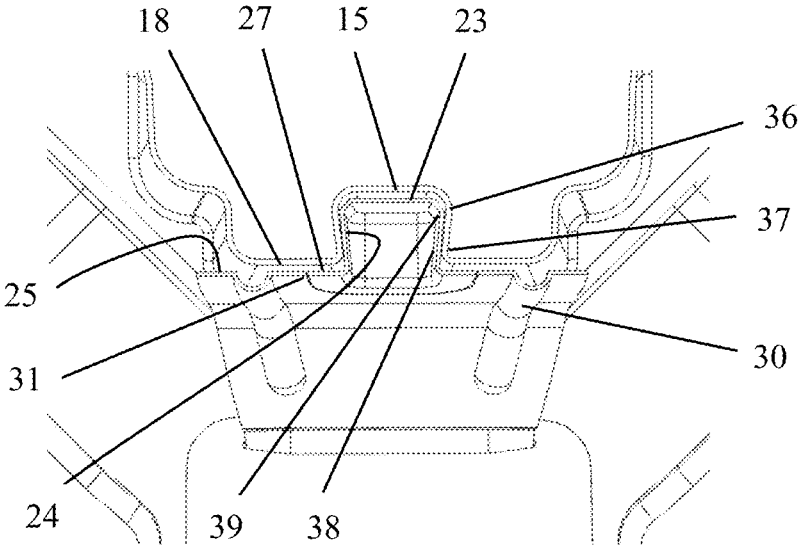
FIG. 4*a* exhibits the cross-section of the pull-tab assembly that is fully engaged with the hold-down receptacle, and displays how it retains the hold-down on the vertical walls of the receptacle due to the undercut.

FIG. 4*a* exhibits the cross-section of the TE undeployed pull-tab assembly 14 wherein the hold-down snap-lock 33 and receptacle snap-lock 5 engagement is interlocked. The pull-tab facet 25 is having an interface with the front facet 18 of the pull-tab receptacle 78, with the center hold-down 27 having a hold-down snap-lock 33 engaging with its counterpart. The internal retaining wall 17 of the pull-tab receptacle 78 or vertical cover wall includes an open slot 16 for finger accessibility, snap-lock engagement, and convenience of manufacture. The protruded wall 15 is spaced from the male lock facet 23, and the apex 39 of the male lock is interlocked or mated with the apex 37 of the female lock of the hold-down due to the interference fit, while the basal 36 of the female lock and basal 38 of the male lock are the undercuts of the snap-lock feature. Notice the undercut sidewall 24 of the hold-down presses against the internal retainer wall 17 (FIG. 3) of the pull-tab receptacle 5. During the pull-tab deployment, the upper apex of the male lock 39 and the undercut wall 24 of the hold-down are strongly pressed against the apex 37 of the female lock and the internal retainer wall of the receptacle snap-lock 5. An interference fit in which the receptacle snap-lock and the hold-down snap-lock having an undercut are conformed and wedged together by a slight taper to increase retention when the cover and the base are separated without deployment of a pull-tab. Furthermore, the retention force between the male and female snap-locks of the pull-tab assembly 6 and receptacle provides a higher value force to withstand the breaking or shearing force of the frangible joints 32 along the precut channel 31. To further reduce the breaking or shearing force of the combined frangible joints 32 in the precut channel 31, they are positioned in a staggered pattern (FIG. 4). The raised/recessed ribs 30 are disposed on both sides of the pull-tab to provide strength and stiffness to the thin wall section of the pull-tab. The resilient hinge 35 is preferably located at the corner of the square, rectangular, or polygonal packages and aligns the pull-tab assembly to the pull-tab receptacle when they are pivoted more than 45 degrees to engage and interlock.

Figure 5:
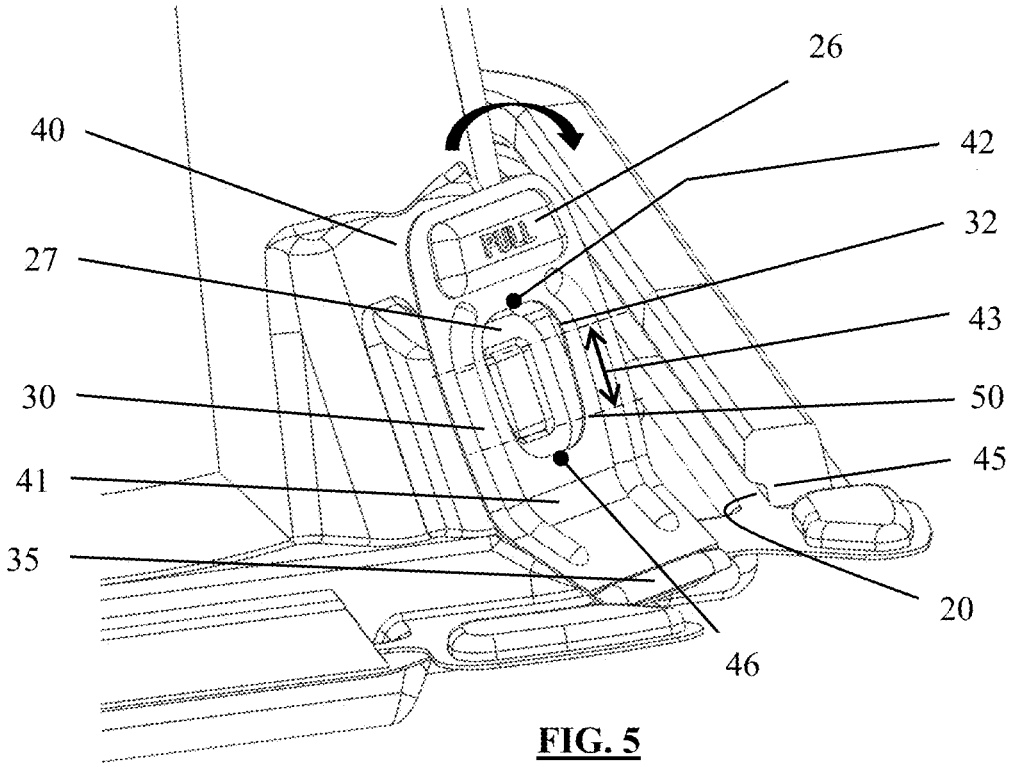
FIG. 5 exhibits an initial opening of the tamper-evident Pull-Tab assembly by pulling it outward and downward from the first separation point of the upper center to the last separation point of the Pull-Tab assembly.
Figure 6:
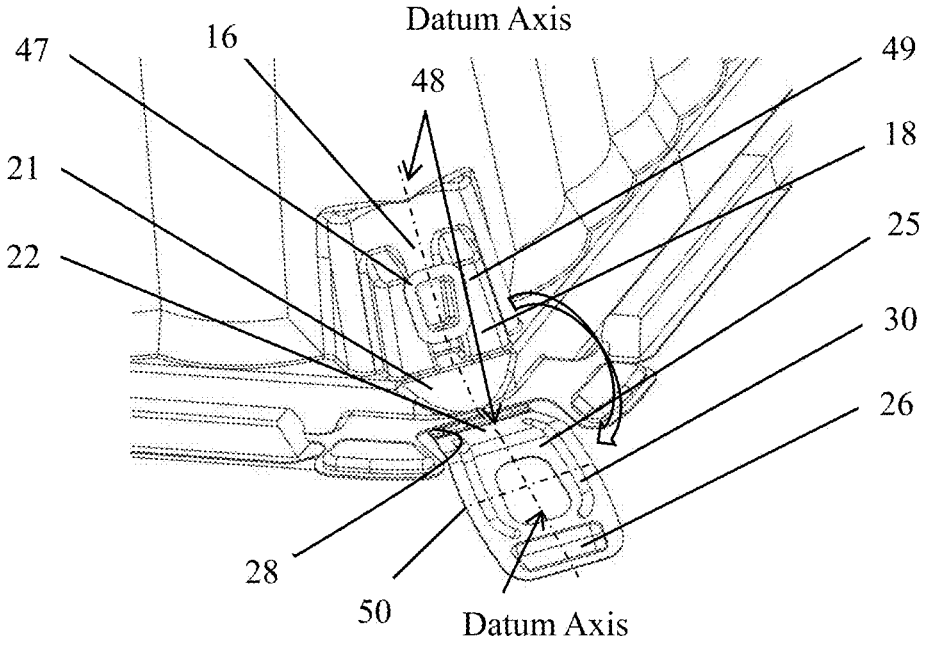
FIG. 6 exhibits a deployment of the tamper-evident Pull-Tab assembly whereas the hold-down is attaching to the hold-tab receptacle when the pull-tab is bending outwardly and downwardly without the hold-down. Both the hold-down receptacle and pull-tab are aligned along the center datum axis.

FIG. 5 exhibits an enlarged view of the TE pull-tab assembly 6 during its initial deployment. During the opening of the TE container, the consumer grasps the finger grip 26 at the top of the pull-tab through a clearance gap 40 that separates the first point 42 at the top of the pull-tab from the pull-down of the pull-tab assembly; the pull-tab continues to pivot outward and downward, breaking the frangible joints 32 along the precut channel 31 before reaching the last point of the separation 46. The hold-down 27 is sequentially attached to the pull-tab receptacle 5. This separation of the hold-tab away from the pull-tab assembly visually indicates tampering because these components are not reattached. Upon the deployment, the resilient pivot hinge 35 springs the pull-tab outward several degrees under natural strain, resulting in a separation between the hold-down and the pull-tab as shown in (FIG. 6). Furthermore, because of the thin sheet of material, the TE pull-tab exhibits a high degree of deformation in the bendable section 43 (FIG. 5) that is clearly displayed tampering if the raised/recessed ribs 30 were omitted. The pull-tab bend 41 can be created in a variety of shapes, angles, or radii to ensure that the pull-tab facet 25 and the receptacle front facet 18 are engaged and interfaced.

FIG. 6 exhibits a partially exploded view of the deployed TE pull-tab assembly wherein the hold-down 27 is attached to the receptacle snap-lock 5 after the consumer pulled the pull-tab outward more than 45 degrees. Through the open slot, the male lock facet 23 is spaced from the cover protruded wall 15 of the hold-down, the hold-down upper wall 47, and broken frangible joints 34 resting against the receptacle front facet 18. The pull-tab facet 25 is pivoted outward and opened flat, revealing a void 51 at about the center of the pull-tab wherein the raised/recessed ribs 30 and finger grip 26 are situated in close proximity. The resilient hinge 35 is guided from the center of the receptacle to the center of the pull-tab assembly along the datum axis 48, while the cover recess edge 28 is shorter than the center line axis 34 of the resilient hinge that provided free rotation of the resilient hinge 35. Hence, through the datum axis, it is disposed about the center of the receptacle snap-lock 5 and the hold-down 27, which allows the hold-down snap-lock 33 to engage and interlock with receptacle snap-lock 5 without breaking the frangible joints when the store clerk first closed the pull-tab assembly 14 by pivoting more than 45 degrees for the engagement. The applicant prefers not having any sharp edge along the broken frangible line 49 on both the hold-down 27 and the inside of the hold-down void 51 after the deployment of the pull-tab. Moreover, the bendable axis 50 exhibited the highest deformation (not shown) in the bendable section 43 due to the thin and weak section of the pull-tab after it was deployed.

Figure 7:
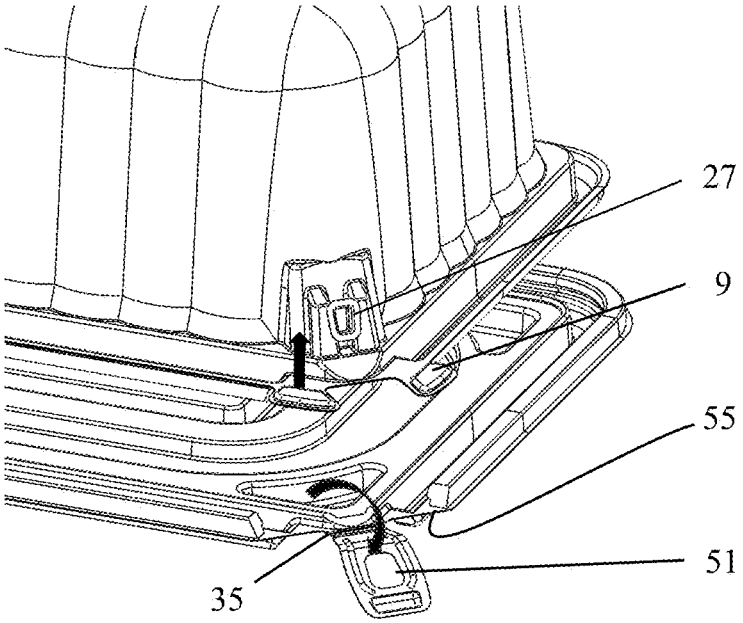
FIG. 7 exhibits an enlarged view of the rectangular/square tamper-evident of Pull-Tab assembly with the pull-tab is being pulled downwards without the hold-tab, while the hold-tab is being attached to the hold-tab receptacle, which indicates of the tampering.

FIG. 7 exhibits an isometric view of opening the TR container when the consumer lifts the lift-tab 9 upward while holding onto the finger grip 26 of the pull-tab. The TR pull-tab was opened with the hold-down still attached to the pull-tab receptacle, and the resilient hinge 35 is maintained and aligned the pull-tab assembly 6, to the pull-tab receptacle 5, and sprung the pull-tab outward from the hinged centerline axis 34 by several degrees to reveal a void 51 at about the center of the pull-tab. This evidence clearly indicated tampering for the consumers since the frangible joints are visually broken. Furthermore, the center of the pull-tab exhibited a high degree of bending about the bending axis 50 or in the bendable section 43. In addition, the lift-tab 9 of the is extended beyond the perimeter edge 55 of the base, and it is located adjacent to the pull-tab assembly 6 when the cover and the base are engaged.

Figure 8:
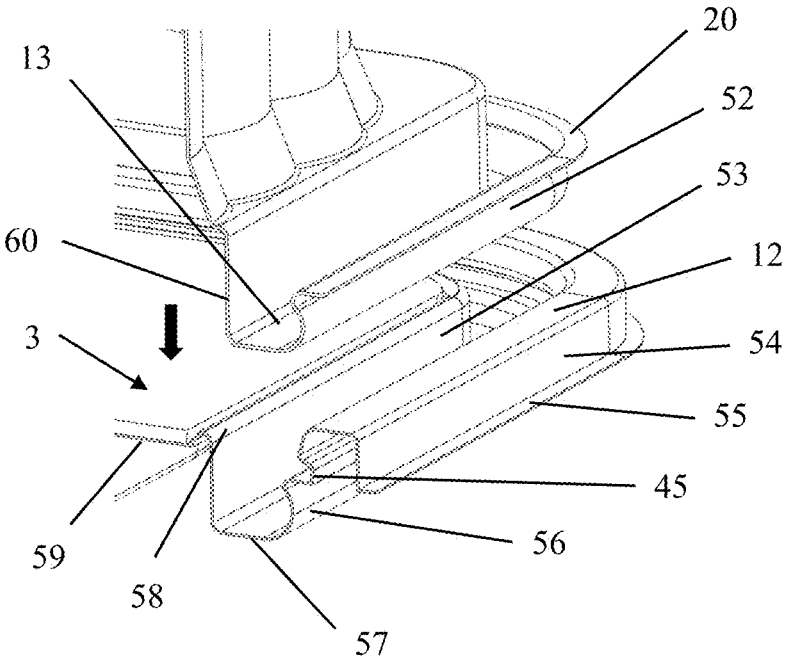
FIG. 8 exhibits a partial section view of the tamper-resistant cake package including the peripheral rim, sealing walls, cake board positioner, base recess and the cake base.

FIG. 8 exhibits an isometric view of the center cross-section of the TR container, with the cover and base are closed and aligned along the central Z axis. The bottom cover wall 13 is adjacent to the peripheral sealing wall 52 and peripheral edge 20, which generally has a thicker wall section than the cover walls and upper walls to provide stiffness and a positive seal or airtight seal when it is engaged with the base. The cover vertical wall 60 is parallel and covers the base vertical wall 53, with the peripheral flange 12, vertical peripheral wall 54, and the perimeter edge 55, providing stiffness and protection against access to the food contents inside the TR package. The perimeter edge 55 and pull-tab facet 25 can also have the same planetary level to reduce the design complexity and manufacturing. The opposite side of the vertical peripheral wall is a recessed groove 45 located below the peripheral flange 12 and above the base sealing wall 56, while the bottom cover wall 13 is aligned face-to-face and rests against the bottom base wall 57. The base support wall 59 has a flat board surface that supports the paperboard or thin plastic plate for the baked goods or food products, and it is held in place by a board-aligned rib 58 that is disposed around the perimeter of the base vertical wall 53. It is further noticed that the primary function of the pull-tab assembly 6 of the tamper-evident is to retain the cover 1 and base 4 together from separation during the undeployed position. Therefore, the peripheral edge 20 and the perimeter edge 55 can be formed in various configurations with or without concealing the peripheral edge.

Figure 9:
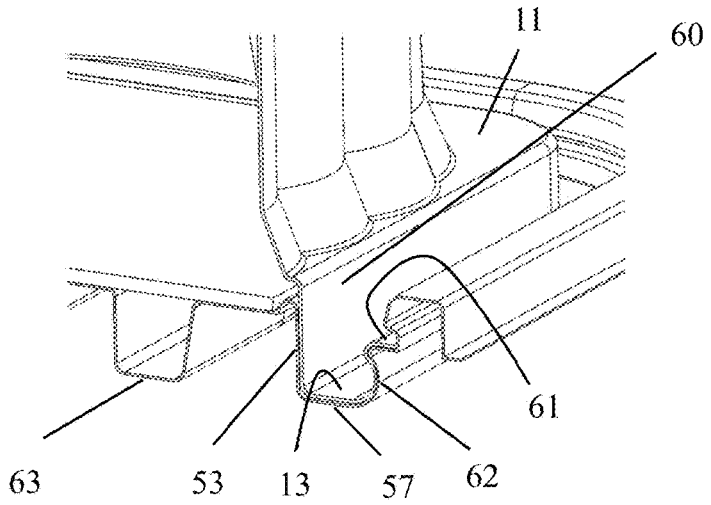
FIG. 9 exhibits a partial section view of the tamper-resistant package including the cover peripheral rim being retained and concealed by the base recess. The seal walls of the cover and base are being pressed against each other, avoiding air and moisture entering inside of the package, and reducing the food shelf-life.

FIG. 9 also exhibits an isometric view of the center cross-section of the TR container, which has a fully closed cover and base. The cake board is held in place by the horizontal holding wall 11 while the cover vertical wall 60 and the base vertical wall 53 are properly aligned. The bottom cover wall 13 rests on the bottom base wall 57 in the base perimeter channel, supporting the package with baked products and snacks. The concealing channel 61 covers and conceals the peripheral edge 20 within the base recess groove 45 while the sealing contact point 62 consists of the cover sealing wall 52 pressing against the base sealing wall 56, forming an airtight seal. This inhibits air transmission and/or the entry of external elements, thereby increasing the shelf life of food products.

FIG. 10 exhibits an isometric view of the TE round cake container, which consists of the cake cover or cover 1, bakery goods or cake 2, cake board 3, and cake base 4, which are concentrically disposed about the central Z axis. The round base includes a perimeter flange 12, which protects the peripheral edge 20 (FIG. 12) from prying while providing stiffness and rigidity to the base. The lift tab 2 extends from the peripheral perimeter edge and beyond the perimeter flange of the base, which is located adjacent to the pull-tab assembly 6 and resilient hinge 35. The TE pull-tab assembly 6 and the pull-tab receptacle 78 are aligned by a resilient hinge 35, and the taper alignment feature 107 (FIG. 14) ensures that the hold-down of the pull-tab assembly 6 engages properly with the pull-tab receptacle 5. The taper alignment feature 107 includes a set of male and female taper walls 110, 108 that are aligned and matched to prevent rotational movement about the central Z axis when they are engaged. The pull-tab is connected to the hold-down by at least a frangible joints 32 located on both sides and/or along the precut channel 31, with the hold-down snap-lock 33 situated in the center. The bendable line axis 50 is located approximately in the horizontal middle of the pull-tab and exhibits a high degree of deformation after the pull-tab deployment. The label panel (69) is formed as a protrusion from the peripheral sidewall (10) and may be optionally configured to accommodate one or more labels for presenting the packaged product, including cakes or other baked goods.

Figure 11:
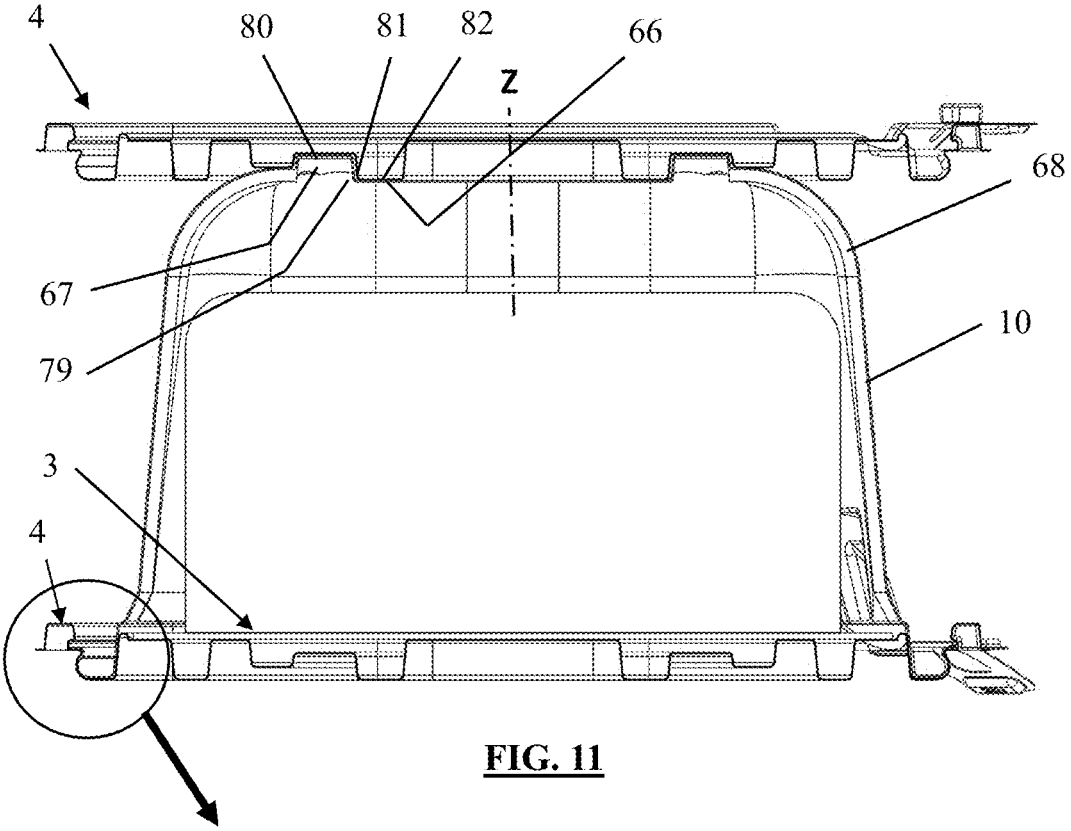
FIGS. 11 & 11*a* exhibits a round or oval tamper-evident cake container in multiple stacking position, wherein the base is engaged and rested on the top of the cover, which the protruded rib of the base fits inside the center recessed wall of the cover, preventing the upper tamper-evident package from sliding/shifting or falling off the store shelves.
Figure 11A:
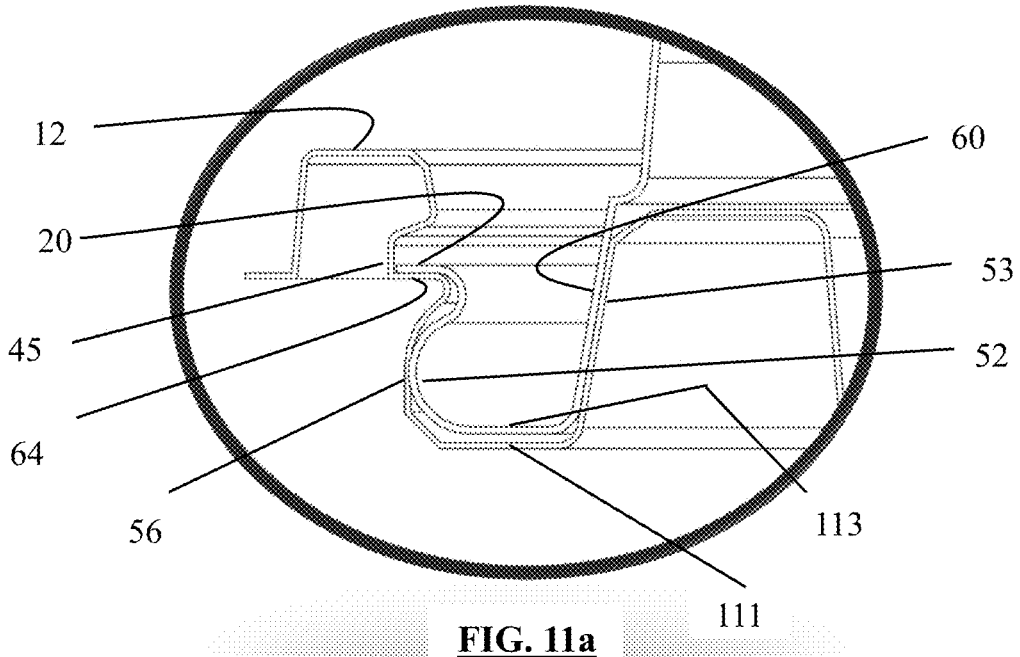

FIGS. 11 & 11*a* exhibit an isometric view of the center cross-section of the TR round container, wherein the TR round package is fully assembled, and a round base 4 is stacked above the cake cover 1, representing multiple stacking of the round TR containers. The circular raised flange 67 protrudes upward into the base recess groove 80 while the flange sidewall 79 is aligned, having a limited distance gap to the circular groove sidewall 81, which prevents the package from shifting radially. It also exhibits an enlarged view of the assembly view of the footing, where the cover 1 is fully engaged with the base 4. The perimeter flange 12 was covered by a concealing channel 45 with its horizontal and structural apparatus retained and concealed the peripheral edge 20 to deter any intention of tampering while the cover sealing wall 52 is pressing against the base sealing wall 56. This prevents the transmission of external elements or air into the TE package. Furthermore, the cover having a peripheral edge 20 is rested on a horizontal flange 64 of the base.

Figure 12:
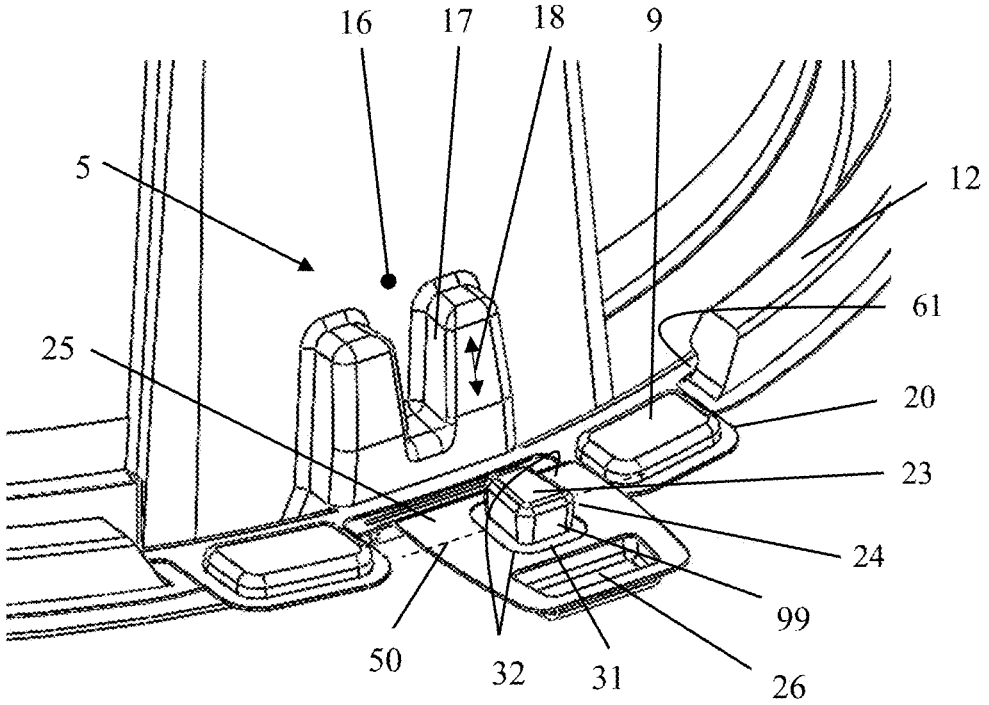
FIG. 12 exhibits an enlargement of the pull-tab assembly before closing the tamper-resistant feature. Both of the lift-tabs are disposed on each side of the pull-tab, which the cover peripheral edge has the same level as the lift-tab peripheral. The center hold-down and the pull-tab receptacle have reversed draft or undercut as male/female configuration to keep them together once it is engaged.

FIG. 12 exhibits an enlarged view of the TE pull-tab assembly view, which is similar to the square and rectangular package; however, it does not have any raised/recess rib 30 on either side of the trapezoid hold-down and without the receptacle ramp and the pull-tab ramp. In addition, the front panel 60 or the pull-tab receptacle 78 can be extended further outward from the central Z axis of the package so that the front receptacle facet 18 of the receptacle with the undercut sidewall 24 of the internal retaining wall 17 is closer to the pull-tab facet 25 to engage easily with the hold-down snap-lock 33 of the pull-tab assembly 6. The front receptacle facet 18 is generally flat and presses up against the pull-tab facet 25 when it is in the undeployed condition. The precut channel 31 is adjacent to the top hold-down sidewall 99 and the finger grip 26 without any frangible joints 32, which are only disposed on both sides of the pull-tab. Further notice the pull-tab exhibits a high degree of deformation at the bendable axis 50 by the pulling force after the deployment, due to the thin-walled section of the material.

Figure 13:
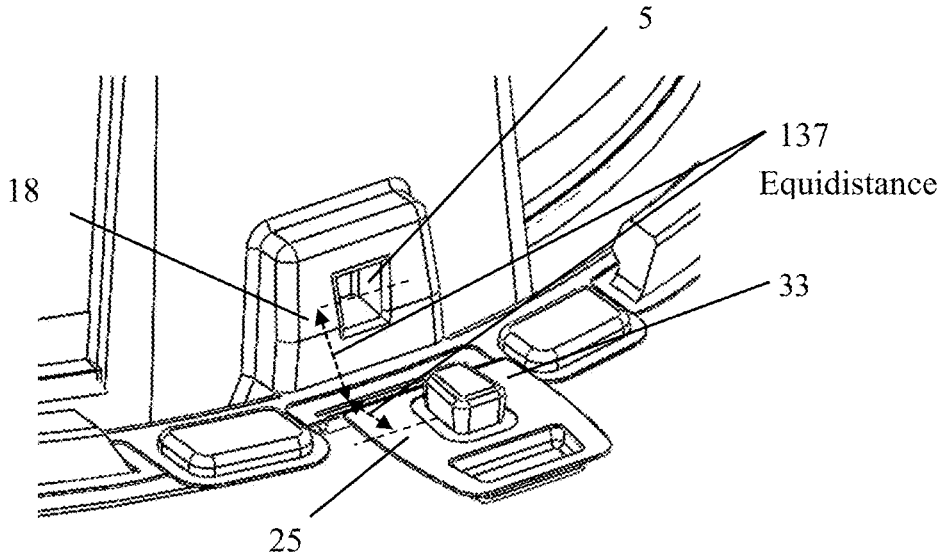
FIG. 13 exhibits an enlargement of the pull-tab assembly, which both male/female snap-lock have a taper configuration as a trapezoid, or square, or rectangular, or round shape without opening the top end.

FIG. 13 exhibits an enlarged view of the TE pull-tab assembly view, where the receptacle snap-lock 5, or the female snap-lock, does not have an open slot 16 as an option. The hold-down snap-lock 33 in of the pull-tab assembly 6 can be formed in various shapes to match the receptacle snap-lock 5. The equidistance 137 between the male and female snap-locks to the hinged center line axis 34 is equal to provide proper alignment when they are engaged and interlocked.

Figure 14:
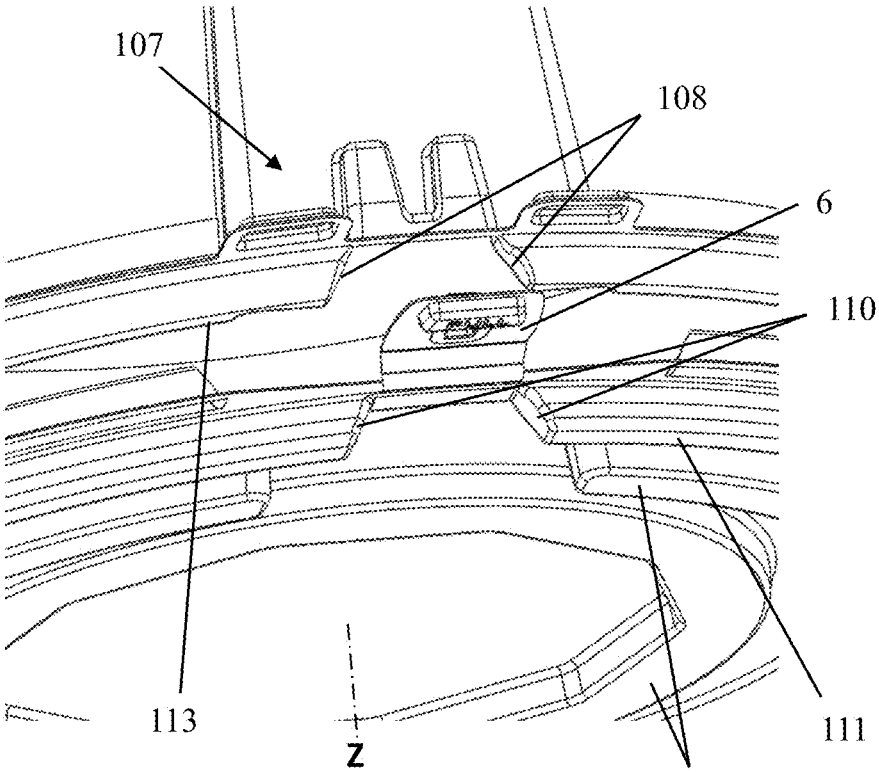
FIG. 14 exhibits an exploded view of the bottom round cake container being opened and the alignment feature disposed at the bottom of the cover and the base.

FIG. 14 exhibits an inverted exploded view of the bottom-round TE package, where the cover and base are concentrically aligned with respect to the central Z axis. The male taper walls 110 of the round base are aligned and matched with the female taper walls 108 of the round cover to prevent rotational movement about the central Z-axis. This taper alignment feature 107 prevents rotational misalignment between the base and the cover. When the hold-down snap-lock and receptacle snap-lock are engaged, the pull-tab assembly 6, and the female taper walls 108 and the male taper walls 110 are in the best position and orientation to ensure correct alignment. The perimeter channel 113 of the bottom cover is aligned and engaged with the peripheral channel 111 of the bottom base, where the perimeter channel 113 (see FIG. 11*a*) is adjacent to the female taper wall 108, and the male taper wall 110, while the cover sealing wall 52 is pressed against the base sealing wall 56 to provide an airtight seal. To maintain the stability of the tamper-evident package, the base bottom walls 112 and peripheral channel 111 have the same horizontal plan level to support the TE package.

Figure 15:
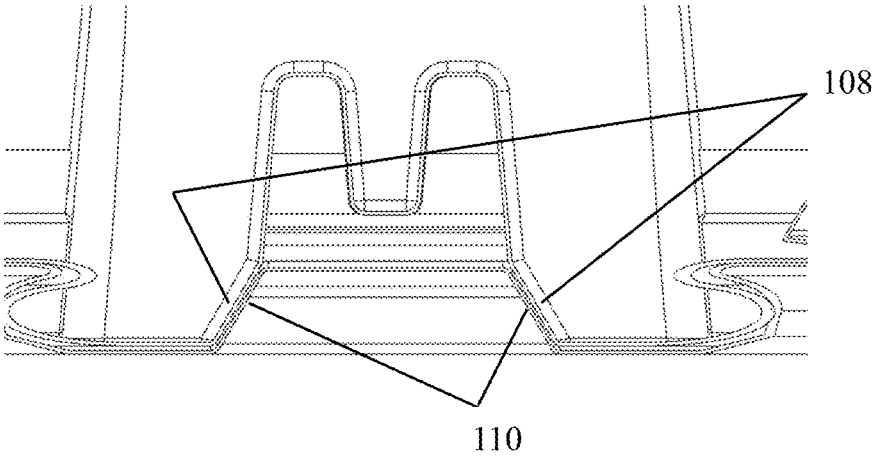
FIG. 15 exhibits a cross-section of the alignment feature when the container is closed, which demonstrates the matching angles of the taper walls between the cover and base with a positive alignment.

FIG. 15 exhibits an exploded view of the cross-section of the taper alignment feature 107 exhibiting the round TR package, which is fully engaged and closed. The female taper walls 108 are mated or interlocked with the male taper walls 110, preventing from freely rotating about the central Z axis.

Figure 16:
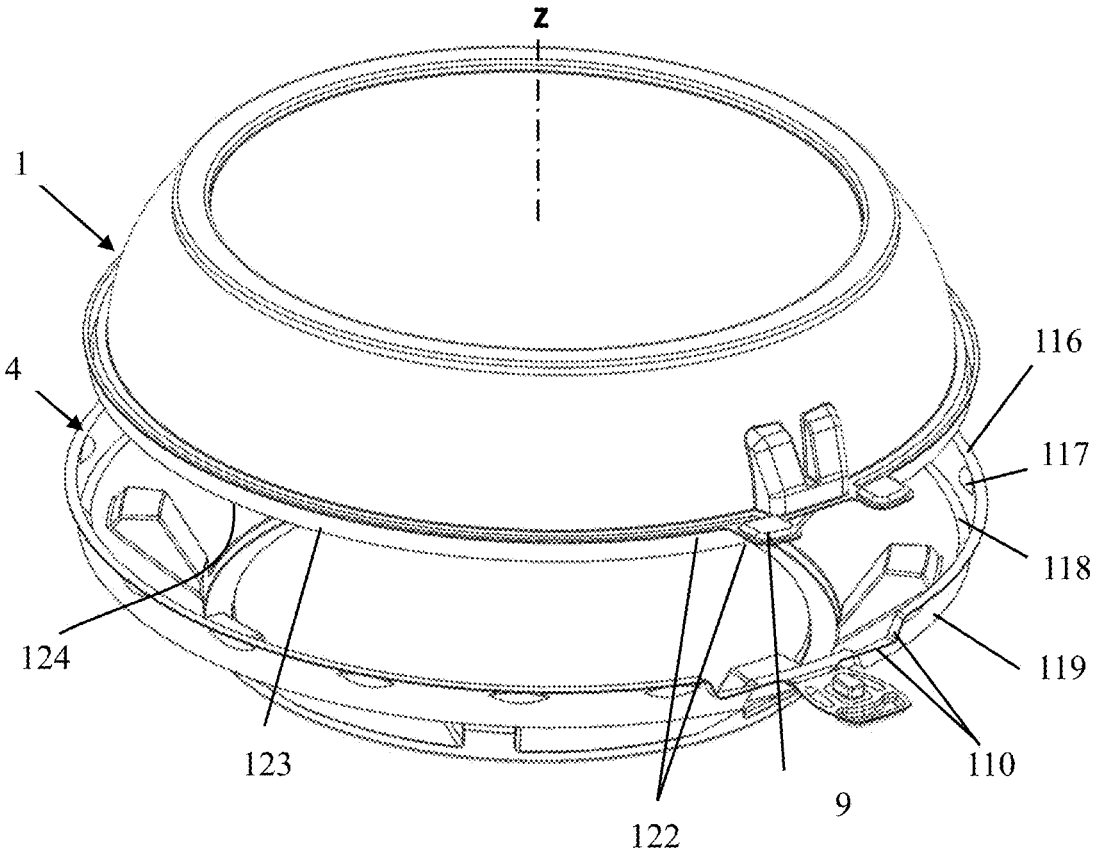
FIG. 16 exhibits the exploded view of the round pie cake container with the pull-tab assembly.

FIG. 16 exhibits an exploded view of the round pie package with the cover 1 and base 115, where the base peripheral flange 116 is close to the peripheral locking sidewall 119, which has multiple base protruding locks 117 that are equally disposed and spaced from each other. The shoulder wall 124 of the cover rests against the flat shoulder wall 118 of the base, while the cover locking wall 123 is slightly pressed against the base locking wall, ensuring that the foods remain fresh in the TR package. The lift tab 9 protrudes outward from the peripheral edge 20 with respect to the central Z axis. Note that the peripheral edge 20 and lift-tab 9 are at the same plane level for simplicity of use and manufacturing.

Figure 17:
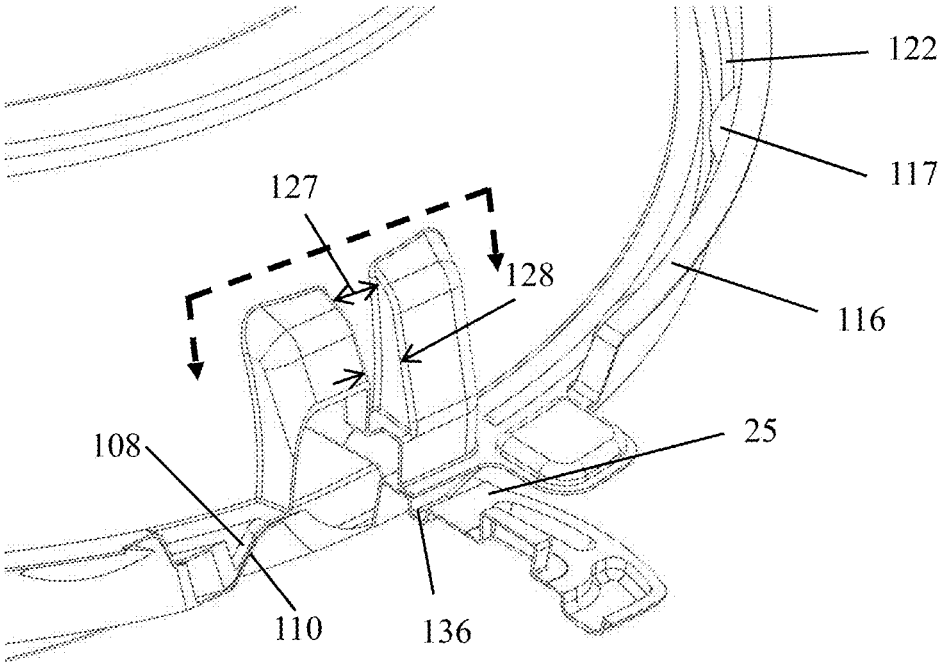
FIG. 17 exhibits a cut-out section of the pull-tab assembly when the package is fully closed with the male and female taper walls interlocking.

FIG. 17 exhibits a partial cross-section of the pull-tab assembly when the round pie package with the cover 1 and base 4 are fully engaged. The plurality of the base-protruding locks 117 conceals and provides a constantly force to the peripheral edge 20 downward, keeping the cover and base together as a TE package, while the base perimeter flange 116 prevents tampering. The male taper wall 110 is aligned and mated or interlocked with the female taper wall 108 to ensure the proper alignment of the datum axis 48 (FIG. 6), allowing the hold-down to be inserted into the receptacle with much less force. The receptacle basal wall gap 127 of the taper alignment feature 107 is wider than the receptacle apex wall gap 128, allowing it to match and retain the hold-down during the pull-tab deployment. The resilient hinge groove 136 has a thin recessed wall and can be formed in various configurations. It is located below the pull-tab facet 25, which allows the pull-tab assembly to be flexible and pivotally bendable at this section; thereby, it can spring outward several degrees away from the receptacle when it is not engaged.

Figure 18:
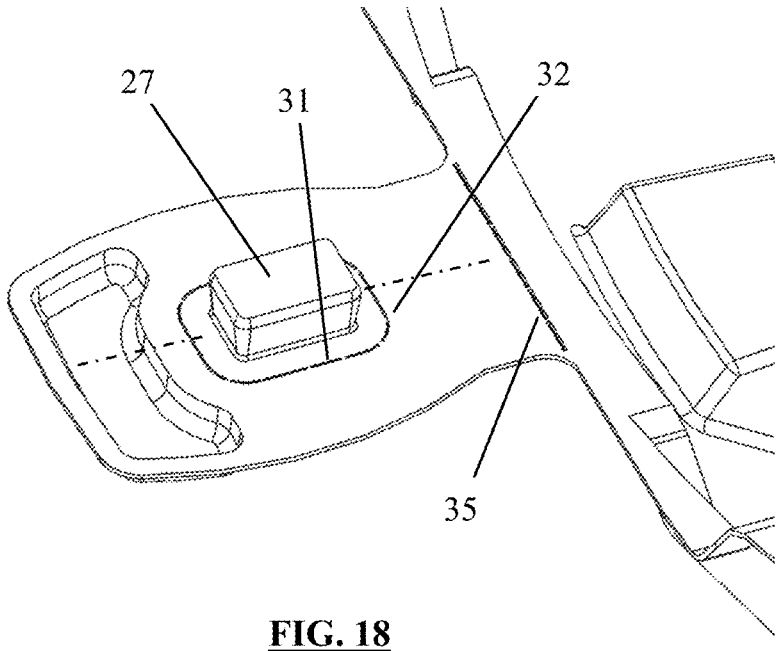
FIGS. 18 & 19 exhibit the isometric views of the pull-tab assembly, which can be formed in various shapes and sizes to suit application. The foldable hinge can also form with different configurations or as simple as a straight line of the precut channel with larger frangible joints.

FIG. 18 exhibits a close-up view of the TE pull-tab assembly, in which the hold-down 27 can be varied with a square, rectangular, bone, oval, or polygonal shape as a hold-down snap-lock, and the precut channel 31 having at least two sides formed in parallel or symmetrical with the hold-down or along the alignment axis. Each side of the precut channel has at least one frangible joint 32 that connects the pull-tab and the hold-down together before the deployment. The frangible joint has a width from 0.005 inch to 0.250 inch (0.12 mm-6.35 mm) depending on the material type and thickness, or at least a minimum of 0.005 inch (0.12 mm) wide. However, the applicant also preferred having a frangible joint 32, with a sufficient retention strength for holding the pull-tab and hold-down together, which is less than the shearing force opening of the pull-tab. In addition, a broken frangible joint might exhibit a small or slightly sharp edge along the frangible line 49 after deployment of the pull-tab assembly. The resilient hinge 35 can be formed in various shapes and sizes (not shown) or just similar to a precut channel 31 with a straight line with multiple frangible joints, allowing the pull-tab assembly to pivot and engage properly with the pull-tab receptacle.

Figure 19:
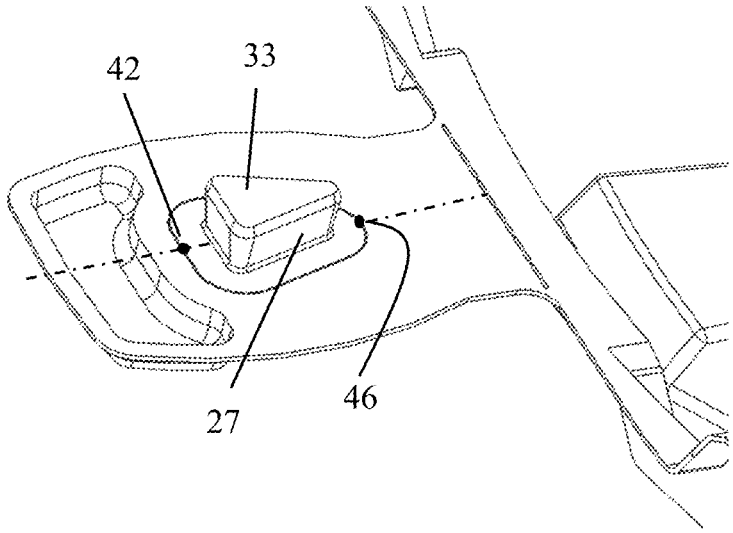

FIG. 19 exhibits also a close-up view of the TE pull-tab assembly, in which the hold-down 27 can be formed in a polygonal, round, triangle, or trapezoidal shape of the hold-down snap-lock 33. The precut channel 31 at the first separation point 42 adjacent to the finger grip has no frangible joint to facilitate the pull-tab deployment while the last separation point 46 is disposed at the opposite site toward to the hinge direction. The hold-down 27 exhibits a slight taper throughout all configurations, while the hold-down snap-lock 33 exhibits a drastic of the "V" shape, which, in turn, increases the retention by wedging between the undercuts of the hold-down and pull-tab receptacle if the cover and base are pulled apart without the deployment of the pull-tab.

Figure 20:
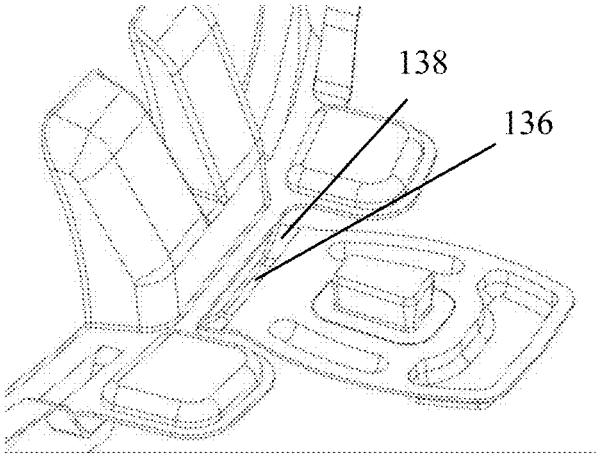
FIG. 20 exhibits an isometric view of the pull-tab assembly when the cover and base are assembled, and having a bottom hinged groove is disposed below the pull-tab facet.

FIG. 20 exhibits a close-up view of the TE pull-tab assembly wherein the cover and base are fully engaged and the lift-tab 93 of the cover is disposed above the base perimeter flange 116, while the pull-tab assembly locates at the center between the lift-tab. The lift-tab 9 can be designed with a single side or both sides of the pull-tab to make it convenient for both left-handed & right-handed people. In addition, the resilient hinge has a resilient hinged groove 136 and taper-hinged ramp 138 set below the pull-tab facet 25, wherein the bottom hinged groove is formed with a curve or a flat surface connecting the perimeter edge and the pull-tab assembly. The taper hinged ramp 138 is disposed on either or both sides of the hinge, which has a curve or a flat surface of a thin cross-section allowing the pull-tab to be foldable and pivotable at this point.

Figure 21:
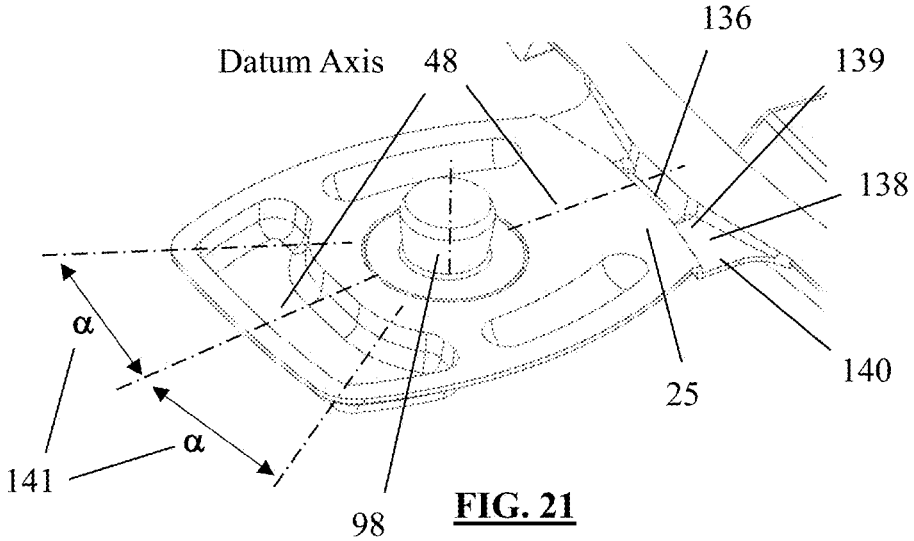
FIGS. 21 & 21*a* exhibit an isometric view and the top view of the pull-tab assembly, which have a configuration of a double fan hinge, and a round male/female hold-down locates at the center of the pull-tab and the center datum axis.
Figure 21A:
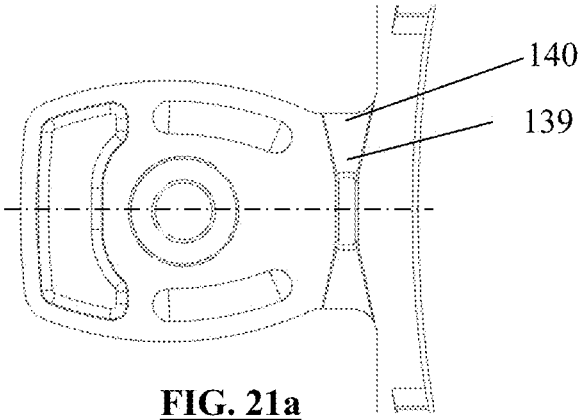

FIGS. 21 & 21*a* exhibit close-up isometric and top views of the pull-tab assembly, which consists of a circular/round hold-down 27 with an undercut sidewall 98 to generate a hold-down snap-lock 33. A hold-down 27 is adjacent to a precut channel 31 and connected to the pull-tab by the frangible joints 32. The pull-tab receptacle 5, 89, 105 and the pull-tab assembly 6, are aligned along the center datum axis 48. There are no frangible joints along the datum axis. It is critical that the frangible joint is positioned at an angel at least with two (2) degrees 141 (α) rotation from the center datum axis of center male/female snap-lock, for the ease of the pull-tab deployment by pulling the pull-tab from the first point to the last point of separation. Similarly to FIG. 20, the pivot hinge has a fan recess on each side of the datum axis 48, and the bottom hinged groove 136 is disposed at the center while the lower ramp recess 139 and the higher ramp recess 140 are both below the pull-tab facet. In addition, these hinge sections are normally thin and tenuous, which makes them the weakest and foldable point, while the flexible flat surfaces keep the pull-tab opening outwardly after the deployment of the pull-tab.

Figure 22:
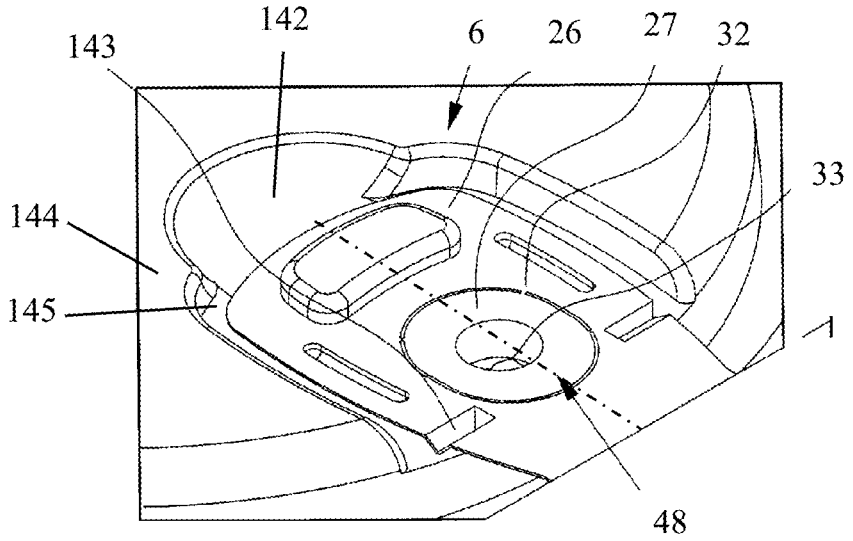
FIG. 22 exhibits an isometric view of the pull-tab assembly, which is disposed in a recessed wall or a horizontal step of the cover wall so it can be flush or below the wall surface. In addition, the cover wall has a finger recess formed adjacent to the finger grip.

FIG. 22 exhibits a similar isometric view of the pull-tab assembly 6, where the cover wall 144 has a horizontal step or recessed wall 145 and a finger recess 142 formed with a pull-tab receptacle 5 to accommodate the pull-tab assembly 6. The pull-tab assembly and the finger grip 100 are disposed of below the surface of the cover wall while aligned along the datum axis 48. In addition, the circular hold-down 27 and the hold-down snap-lock 73 are spaced from the precut channel 31 and connected to the pull-tab by frangible joints 32. Notice that the pull-tab assembly and the pull-tab receptacle are connected and laid face-wise during the undeployed position, in which the horizontal recessed wall 145 is parallel to the pull-tab facet 25. The horizontal step or recessed wall also functions as a blockage and prevents prying from the sides of the pull-tab assembly. Another option is having the pull-tab assembly laid flat against the cover wall 144 for ease of manufacturing.

Figure 23:
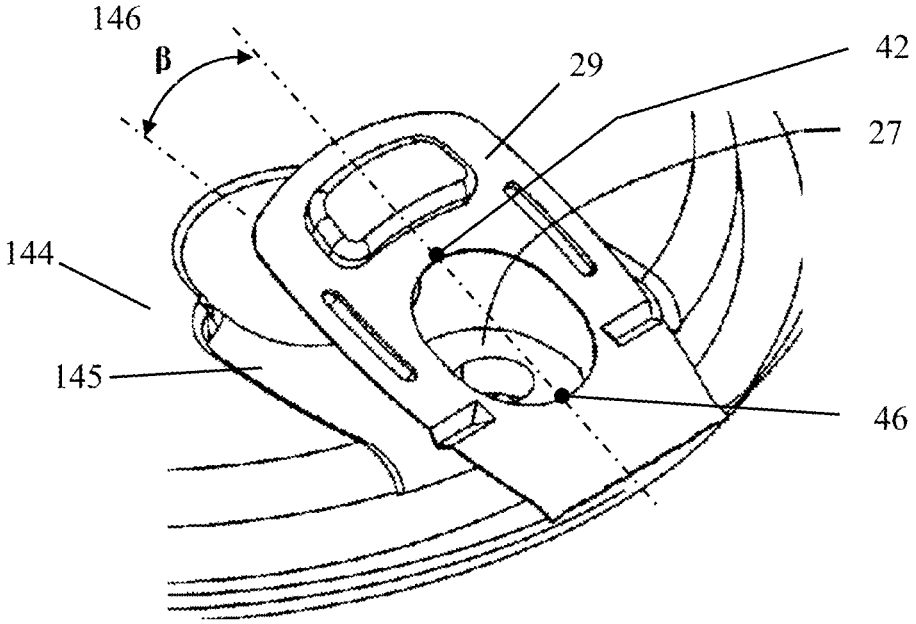
FIG. 23 exhibits an isometric view of the pull-tab assembly, where the pull-tab is being opened and pivoted outward several degrees from the cover wall by a resilient hinge. The hold-down is attached to the receptacle whereas the pull-tab exhibits a void at about the center.

FIG. 23 exhibits an isometric view of the pull-tab being deployed or opened by an individual who inserts their finger into an open space of the finger recess 142 and lifts the pull-tab upward or outward, resulting in a higher retention force than the breaking or shearing force of the frangible joint. Consequently, this motion breaks and separates the hold-down 27 and pull-tab 29, from the first point 42 of separation downward to the last point 46 of separation. The strain force from the resilient hinge keeps the pull-tab apart from the cover wall 144 more than 45 degrees β 146, and the hold-down is attached to the receptacle when the pull-tab is pivoted outward, exhibiting a hold-down with a void 51 at about the center, indicating tampering during the deployment.

FIG. 24 exhibits an isometric view of the tamper-evident container, which is inverted from the previous product application or figures, wherein the food products are placed inside the peripheral sidewall 10 of a the container, and the cover 1 is now a lid. The cover has an upper wall 150 with a raised or peripheral flange 12 to increase stiffness and rigidity while it can be used for multiple stacking of the packages. The pull-tab assembly 6 is connected to the peripheral edge 20 by a resilient hinge 35, which extends outward from the center of the Z axis. The peripheral edge 20 covers the perimeter edge 55 in the recess groove, and the cover sealing wall presses against the base sealing wall to form an airtight seal when the package is closed. The pull-tab assembly is attached to a peripheral edge 20 of the cover by a resilient hinge 35, which is extended outward from the center of the Z axis. Additionally, the pull-tab assembly 6 aligns, connects, and attaches to the pull-tab receptacle 78 through the center datum Axis with a mechanical snap-lock 160 in (FIG. 25). The taper alignment feature 107 between the cover and base prevents rotational misalignment and ensures the proper alignment of the pull-tab assembly 6 to the pull-tab receptacle 161 when they are engaged. When the package is closed and assembled, the gripping lift-tab tab 9 is extended from the perimeter edge 55 of the container and located adjacent to the pull-tab to help the consumer to facilitate the opening of the package.

Figure 25A:
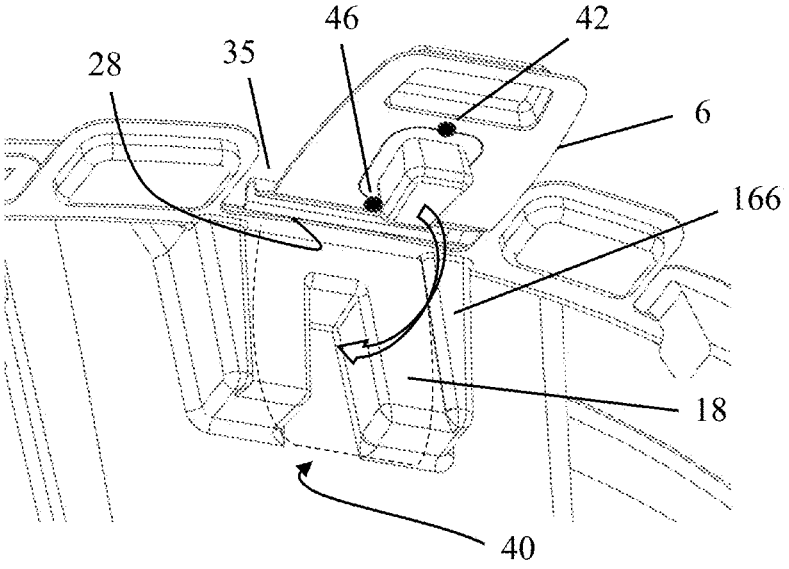

FIGS. 25 & 25*a* exhibit enlarged views of the pull-tab assembly 6 before it engages, where the hold-down 27 is separated from the pull-tab 29 by a precut channel 31 and connected by frangible joints 32. A hold-down snap-lock 33 of the hold-down 27 can be designed in various shapes and sizes, which is matched and interlocked with a receptacle snap-lock 5 of the pull-tab receptacle 78.

These receptacle walls 163 protrude from the upper sidewall 10 of the base. The peripheral edge 20 is extended from the central axis Z toward the center line 34 of the hinge. The resilient hinge 35 ensures that the pull-tab assembly and receptacle are aligned about the center datum axis during the undeployment condition and maintains the pull-tab pivot outward and spaced from the receptacle facet 18 after deployment. The minimum pivotal angel of 45 degrees is required for the engagement or disengagement of the pull-tab assembly to the receptacle.

Additionally, the pull-tab assembly is spaced from a peripheral sidewall 10 or a label panel 69 and has a clearance gap to facilitate grasping the pull-tab and opening a container. The pull-tab is designed without a raised or recessed rib 30, resulting in a higher degree of deformation, which enhances the visual of the tampering indicator when the pull-tab is pulled and deployed. The hold-down snap-lock 33 and the receptacle snap-lock 5 are matched and conformed with a slight taper of a "V" shaped structure with undercuts to increase retention when the lid 1 and container 4 (being inverted) are forced apart without the deployment of the pull-tab. The pull-tab assembly 6, hold-down 27 would continue to increase retention by wedging with the receptacle depending on the product weight inside the package. Furthermore, FIG. 25, exhibits an opened pull-tab assembly prior to engaging with the receptacle, with the finger grip 26 is disposed at the top of the pull-tab. A precut channel 31 is separated the hold-down and the pull-tab by frangible joints 32 while the resilient hinge 35 ensures a proper alignment and engagement of the hold-down snap-lock 33 and receptacle snap-lock 5 through the center datum Axis. Notice that the pull-tab facet 25 is rested against the pull-tab receptacle facet 18 when they are not deployed (similar as shown FIGS. 5 & 10). It can also be placed flush against the receptacle facet 18 and below a receptacle step 166 of the receptacle to prevent the pull-tab from being pried off. There is a clearance gap 40 between the pull-tab assembly 6 and the sidewall of the container that allows access to the finger; thus, the user applied the pulling force, which is generally greater than the retention strength to break and sever the staggered frangible joints along the precut channel of the pull-tab assembly. This evidence clearly indicated tampering for the consumers because the frangible joints is visually broken when the hold-down separated and detached from the pull-tab assembly by attaching to the receptacle, revealing a void at about the center of the pull-tab.

I claim:

1. A method of making a tamper-evident packaging container comprising:

providing a cover having a cover upper wall, a cover peripheral edge, a cover peripheral sidewall, and a cover bottom wall;

providing a base having a base vertical wall, a base perimeter edge, a base support wall, and a bottom base wall;

forming a pull-tab receptacle on the base, the pull-tab receptacle defining a center datum axis;

attaching a pull-tab assembly to the cover peripheral edge by a resilient hinge, the pull-tab assembly comprising a pull-tab and a hold-down and being configured to pivot about the center datum axis from a stowed position into alignment with and engagement with the pull-tab receptacle when the cover is engaged to the base;

separating the hold-down from the pull-tab by forming a precut channel;

forming a frangible joint within the precut channel to connect the hold-down to the pull-tab, the frangible joint having a width of 0.005 inch to 0.250 inch (0.12 mm to 6.35 mm);

forming a hold-down snap-lock on the hold-down and a receptacle snap-lock on the pull-tab receptacle, the hold-down snap-lock and the receptacle snap-lock configured to mechanically interlock with a V-shaped undercut to retain the hold-down within the pull-tab receptacle; and configuring the pull-tab assembly such that outward movement of the pull-tab from the stowed position to a deployment position relative to the cover severs the frangible joint and reveals a void through a central portion of the pull-tab upper wall while the hold-down remains retained within the pull-tab receptacle.

2. The method of making a tamper-evident packaging container according to claim 1, further comprising forming the hold-down snap-lock with an undercut wall that is configured to interlock with the receptacle snap-lock to provide a retention force greater than—a breaking force of the frangible joint.

3. The method of making a tamper-evident packaging container according to claim 1, further comprising configuring the resilient hinge to permit the pull-tab assembly to pivot more than 45 degrees relative to the cover to engage or disengage with the pull-tab receptacle.

4. The method of making a tamper-evident packaging container according to claim 1, further forming a pull-tab snap-lock on the pull-tab, the pull-tab snap-lock and the receptacle snap-lock each having a polygonal, circular, square, rectangular, trapezoidal, oval, or tapered profile centered about the center datum axis and configured to provide an undercut mechanical interlock.

5. The method of making a tamper-evident packaging container according to claim 1, further comprising forming the pull-tab to include a pull-tab upper wall, the pull-tab upper wall comprising a raised or recessed groove configured to increase stiffness and facilitate stacking.

6. The method of making a tamper-evident packaging container according to claim 1, further comprising forming the cover peripheral edge as a horizontal edge configured to rest on a horizontal flange extending from the base perimeter edge.

7. The method of making a tamper-evident packaging container according to claim 1, further comprising forming the pull-tab receptacle to include a basal wall gap narrower than an apex wall gap, to create an undercut for retaining the hold-down.

8. The method of making a tamper-evident packaging container according to claim 1, further comprising forming the cover, the base, and the pull-tab assembly from a material selected from the group consisting of thermoplastics, thermosets, composites, recyclable plastics, compostable polymers, and biodegradable polymers.

9. A method of making a tamper-evident packaging container comprising:

providing a cover and a base, the base being disposed about a central Z axis;

forming an alignment feature on at least one of the cover and the base to prevent rotational misalignment between the cover and the base;

attaching the pull-tab assembly to the cover by a resilient hinge, the pull-tab assembly comprising a pull-tab and a hold-down connected by a frangible joint, the pull-tab assembly configured to pivot a pull-tab assembly to the cover by a resilient hinge, about a center datum axis;

forming a hold-down snap-lock on the hold-down and a receptacle snap-lock on the base, the hold-down snap-lock and the receptacle snap-lock configured to interlock via a "V" shaped structure with an undercut for retention;

configuring the hold-down snap-lock to provide a retention force greater than a breaking force or a shearing force of a frangible joint;

forming a hold-down snap-lock on the hold-down and a receptacle snap-lock on the base, the hold-down snap-lock and the receptacle snap-lock configured to interlock via a V-shaped structure with an undercut for retention; and configuring the pull-tab assembly such that outward movement of the pull-tab severs the frangible joint progressively from a first point of the frangible joint to a last point of the frangible joint while the hold-down remains attached to the base.

10. The method of making a tamper-evident packaging container according to claim 9, further comprising forming the alignment feature as a female taper wall on the cover and a male taper wall on the base configured for mutual engagement.

11. The method of making a tamper-evident packaging container according to claim 9, further comprising forming a raised rib on both sides of the pull-tab to increase stiffness of the pull-tab.

12. The method of making a tamper-evident packaging container according to claim 9, further comprising forming a bendable section of the pull-tab, the bendable section configured to deform more than 45 degrees relative to the center datum axis during deployment of the pull-tab.

13. The method of making a tamper-evident packaging container according to claim 9, wherein the hold-down snap-lock provides a retention force greater than a breaking force or a shearing force of the frangible joint.

14. The method of making a tamper-evident packaging container according to claim 9, further comprising forming a recess groove in the base to receive a peripheral edge of the cover and forming a sealing wall on each of the cover and the base to provide an airtight seal.

15. The method of making a tamper-evident packaging container according to claim 9, wherein a precut channel is formed between the pull-tab and the hold-down and the frangible joint is arranged in a staggered pattern within the precut channel.

16. A method of making tamper-evident packaging container comprising:

forming a cover having a pull-tab assembly attached to a peripheral edge by a resilient hinge;

forming the pull-tab assembly to include a hold-down separated from a pull-tab by a precut channel;

connecting the pull-tab to the hold-down by arranging a frangible joint in a staggered pattern within the precut channel;

providing a base having a pull-tab receptacle protruding from a vertical sidewall, the pull-tab receptacle including a receptacle snap-lock and defining a center datum axis;

forming a hold-down snap-lock on the hold-down with an undercut wall conformed to mate and interlock with the receptacle snap-lock to provide a retention force greater than a shearing force of the frangible joint;

spacing the pull-tab assembly, when the cover is positioned on the base, from the vertical sidewall of the base to provide a clearance gap; and configuring the pull-tab such that an applied force greater than a breaking force of the frangible joint severs the frangible joint along the precut channel.

17. The method of making tamper-evident packaging container according to claim 16, further comprising forming an alignment feature preventing rotational misalignment between the cover and the base.

18. The method of making tamper-evident packaging container according to claim 16, further comprising forming the hold-down snap-lock and the receptacle snap-lock with mating profiles located about the center datum axis and configured to mechanically interlock.

19. The method of making tamper-evident packaging container according to claim 16, further comprising forming the frangible joint to have a width from 0.005 inch to 0.250 inch (0.12 mm to 6.35 mm).

20. The method of making tamper-evident packaging container according to claim 19, further comprising orienting the frangible joint at an angle of at least two degrees relative to the center datum axis to facilitate pull-tab deployment by pulling the pull-tab from a first point to a last point of separation.

21. The method of making a tamper-evident packaging container according to claim 16, further comprising positioning the pull-tab to lie flush against a receptacle facet of the pull-tab receptacle, or below a recess or a step formed in the pull-tab receptacle, to prevent prying of the pull-tab.

22. The method of making a tamper-evident packaging container according to claim 16, further comprising configuring the resilient hinge to bias the pull-tab outward and spacing from the pull-tab receptacle after deployment of the pull-tab.

23. The method of making a tamper-evident packaging container according to claim 16, further comprising selecting a material for the cover, the base, and the pull-tab assembly are selecting from the group consisting of thermoplastics, thermosets, composites, recyclable plastics, compostable, biodegradable, ovenable polymers, and combination thereof.

* * * * *